US011642865B2

(12) United States Patent
Tateishi et al.

(10) Patent No.: US 11,642,865 B2
(45) Date of Patent: May 9, 2023

(54) CORRUGATED CARDBOARD SHEET MANUFACTURING SYSTEM

(71) Applicant: MITSUBISHI HEAVY INDUSTRIES MACHINERY SYSTEMS, LTD., Kobe (JP)

(72) Inventors: Koki Tateishi, Tokyo (JP); Akira Ogino, Mihara (JP); Yusuke Hazui, Tokyo (JP); Hiroshi Ishibuchi, Tokyo (JP); Takaharu Hiroe, Tokyo (JP)

(73) Assignee: MITSUBISHI HEAVY INDUSTRIES MACHINERY SYSTEMS, LTD., Kobe (JP)

( * ) Notice: Subject to any disclaimer, the term of this patent is extended or adjusted under 35 U.S.C. 154(b) by 588 days.

(21) Appl. No.: 16/500,678

(22) PCT Filed: Feb. 23, 2018

(86) PCT No.: PCT/JP2018/006675
§ 371 (c)(1),
(2) Date: Dec. 12, 2019

(87) PCT Pub. No.: WO2018/190005
PCT Pub. Date: Oct. 18, 2018

(65) Prior Publication Data

US 2020/0207051 A1 Jul. 2, 2020

(30) Foreign Application Priority Data

Apr. 14, 2017 (JP) ..... JP2017-080789

(51) Int. Cl.
*B31F 1/28* (2006.01)
*B31F 1/36* (2006.01)

(52) U.S. Cl.
CPC ..... *B31F 1/284* (2013.01); *B31F 1/36* (2013.01)

(58) Field of Classification Search
CPC ..... B31F 1/205; B31F 1/2831; B31F 1/284; B31F 1/2845; B31F 1/285; B31F 1/36
See application file for complete search history.

(56) References Cited

U.S. PATENT DOCUMENTS

2005/0284579 A1* 12/2005 Ishibuchi ..... B31F 1/284 156/367
2008/0077267 A1 3/2008 Ishibuchi et al.
(Continued)

FOREIGN PATENT DOCUMENTS

JP H06-87009 A 3/1994
JP 2003-231193 B2 8/2003
(Continued)

OTHER PUBLICATIONS

Japan Patent Office, "Office Action for Japanese Patent Application No. 2017-080789," dated Feb. 18, 2020.

*Primary Examiner* — Chelsea E Stinson
(74) *Attorney, Agent, or Firm* — Manabu Kanesaka; Benjamin Hauptman; Kenneth Berner

(57) ABSTRACT

The corrugated cardboard sheet manufacturing system including a production state information acquisition device; a control value information acquisition device for acquiring control value information of a control element of a corrugated cardboard sheet manufacturing apparatus exerting an influence on the warp of a corrugated cardboard sheet; a warp information acquisition device for acquiring information of a warp amount of the corrugated cardboard sheet; a storage device for storing a performance data set including at least production state information, the control value information, and the warp information; a pre-control table storing a standard control value of the control element set in accordance with a production state; a correction table for correcting the standard control value to set an initial control value; an update device for updating the correction table by
(Continued)

reflecting the performance data set; and control device for performing feedforward control of the control element using the initial control value.

2 Claims, 15 Drawing Sheets

(56) References Cited

U.S. PATENT DOCUMENTS

| | | | |
|---|---|---|---|
| 2011/0011522 | A1 | 1/2011 | Kohler |
| 2015/0158264 | A1 | 6/2015 | Sofinowski |

FOREIGN PATENT DOCUMENTS

| | | | |
|---|---|---|---|
| JP | 3735302 | B2 | 1/2006 |
| JP | 3841580 | B2 | 11/2006 |
| JP | 3905767 | B2 | 4/2007 |
| JP | 2007-112024 | A | 5/2007 |
| JP | 2008-074007 | A | 4/2008 |
| JP | 5251954 | B2 | 7/2013 |
| JP | 4991576 | B2 | 8/2013 |
| JP | 2013-200780 | A | 10/2013 |

* cited by examiner

CORRUGATED CARDBOARD SHEET MANUFACTURING SYSTEM

TECHNICAL FIELD

The present invention relates to a corrugated fiberboard sheet manufacturing system suitable for suppressing warping of a corrugated fiberboard.

BACKGROUND ART

A corrugated fiberboard is manufactured by making a single-faced web, which is made by attaching a medium rolled on one liner (top liner) with glue, and attaching the other liner (bottom liner) onto a medium side of the single-faced web.

In this manufacturing process, respective sheets including the top liner, the bottom liner, the single-faced web, and the corrugated fiberboard are heated by respective preheaters including a top liner preheater, a single-faced web preheater, and a bottom liner preheater, or a double facer. Adhesive application is performed thereon by a single facer or a glue machine. At that time, however, when a heated amount or an adhesive application amount is not an appropriate value, warping occurs on the completed corrugated fiberboard.

For this reason, in a corrugated fiberboard manufacturing device of the related art, the suppression of warping is achieved by feedforward-controlling various control elements such as a preheater winding angle through matrix-control based on a production state such as a paper width and a basis weight of a sheet. In the matrix-control, since initial control values of various control values are determined according to a production state in accordance with a pre-control table stored in advance, the various control values can be set to appropriate values according to a production state, and the suppression of warping can be achieved.

A corrugated fiberboard warping rectification system in which such matrix-control is improved is disclosed in PTL 1. In the warping rectification system disclosed in PTL 1, initial control values of various control values are set through matrix-control based on a production state. However, a warped amount of a corrugated fiberboard is detected with the naked eye of an operator, a CCD camera, or a displacement sensor, and the various control values are corrected through feedback control based on a detection result.

CITATION LIST

Patent Literature

[PTL 1] Japanese Patent No. 3735302

SUMMARY OF INVENTION

Technical Problem

However, in the corrugated fiberboard warping rectification system disclosed in PTL 1, appropriate amounts of the various control values differ according to a production state even when the various control values are made appropriate through feedback control. Therefore, each time a production state changes, feedback control is required to be started over with the various control values determined through matrix-control as initial control values.

For this reason, it requires time until the various control values are made appropriate through feedback control after a production state is changed, the corrugated fiberboard immediately after a production state change cannot avoid becoming damaged paper since warping is not sufficiently suppressed.

The present invention is devised in view of such problems, and an object thereof is to provide a corrugated fiberboard sheet manufacturing system that can quickly suppress the warping of a corrugated fiberboard.

Solution to Problem (1) According to an aspect of the present invention, in order to achieve the object, there is provided a corrugated fiberboard sheet manufacturing system including production state information acquisition means for acquiring production state information related to a production state of a corrugated fiberboard manufacturing device, control value information acquisition means for acquiring control value information of a control element of the corrugated fiberboard manufacturing device which affects a warped amount of a manufactured corrugated fiberboard, warping information acquisition means for acquiring warping information related to the warped amount of the corrugated fiberboard, storage means for storing an actual data set including at least the production state information, the control value information, and the warping information, a pre-control table in which a standard control value of the control element is set according to the production state, a correction table for setting an initial control value by correcting the standard control value, updating means for updating the correction table by reflecting the actual data set, and control means for feedforward-controlling the control element by using the initial control value.

(2) It is preferable that a correction amount table, in which a correction amount for correcting the standard control value of the pre-control table is set according to the production state, be further included as the correction table and addition means for calculating the initial control value by adding the correction amount to the standard control value be further included.

(3) It is preferable that a correction amount table, in which a correction amount for correcting the standard control value of the pre-control table is set according to the production state, and a control table, in which the initial control value is set according to the production state, be further included as the correction tables. It is preferable that the updating means update the correction amount table. It is preferable that a value obtained by adding the correction amount of the correction amount table to the standard control value of the pre-control table is input into the control table as the initial control value.

(4) It is preferable that a control table after correction, in which an update value of the standard control value of the pre-control table is set according to the production state, and a control table, in which the initial control value is set according to the production state, be further included as the correction table. It is preferable that the updating means update the control table after correction. It is preferable that the standard control value of the pre-control table be input into the control table as an initial value and be updated by using the update value of the control table after correction.

(5) It is preferable that a control table after correction, in which an update value of the standard control value of the pre-control table is set according to the production state, be further included as the correction table. It is preferable that the updating means update the control table after correction and the standard control value of the pre-control table be input into the control table after correction as an initial value.

(6) It is preferable that first prediction model generation means for generating a warping prediction model, through which the warped amount is predicted, based on the actual data set be further included. It is preferable that the updating means update the correction table based on the actual data set having the smallest warped amount out of warped amounts including the predicted warped amount.

(7) It is preferable that temperature acquisition means for acquiring a temperature of base paper from which the corrugated fiberboard is formed be further included. It is preferable that the actual data set further include the temperature. It is preferable that the corrugated fiberboard sheet manufacturing system further include second prediction model generation means for generating a temperature prediction model, through which the temperature is predicted, based on the actual data set. It is preferable that the updating means update the correction table based on the actual data set in which the temperature including the predicted temperature is higher than a threshold temperature.

(8) It is preferable that the first prediction model generation means predict the warped amount with a margin provided in consideration of prediction uncertainty.

(9) It is preferable that restriction means for restricting a breadth of change of the initial control value accompanying update of the correction table such that the breadth of change does not exceed a threshold value be further included.

Advantageous Effects of Invention

In the present invention, actual data sets that each include at least the production state information, the control value information, and the warping information are stored in the storage means. The correction table is updated based on a control value having a good warped amount of the corrugated fiberboard, out of the actual data sets stored in the storage means.

After then, in the same production state, since the control element is feedforward-controlled based on an initial setting value obtained by using the updated correction table, the control element can be quickly optimized, and thus the warping of the corrugated fiberboard can be quickly rectified.

In addition, since the standard control value of the pre-control table is left without being changed, it is possible to manage how much the standard control value is corrected based on the actual value. As a result, by analyzing a cause that the standard control value had to be corrected, for example, it is possible to achieve optimization of the standard control value in a production state where there is no actual value.

Since the standard control value set through the pre-control table is corrected to become the initial control value by using the correction table updated based on the actual data set, the pre-control table is a base for the initial control value, and information shown in the pre-control table can be utilized.

DESCRIPTION OF EMBODIMENTS

Hereinafter, embodiments of the present invention will be described with reference to the drawings.

The embodiments described below are merely examples, and are not intended to exclude application of various modifications and techniques that are not specified in the embodiments below. Respective configurations of the embodiments below can be variously modified and executed without departing from the spirit thereof, can be selected and discarded if necessary, or can be combined with each other as appropriate.

[1. Configuration of Corrugated Fiberboard Manufacturing Device]

A corrugated fiberboard sheet manufacturing system of the present invention is configured with a corrugated fiberboard manufacturing device and a production management device that controls the corrugated fiberboard manufacturing device. The respective corrugated fiberboard sheet manufacturing systems of the embodiment have the corrugated fiberboard manufacturing devices that have the same configuration, and configurations of the production management devices are different from each other.

Figure 1:
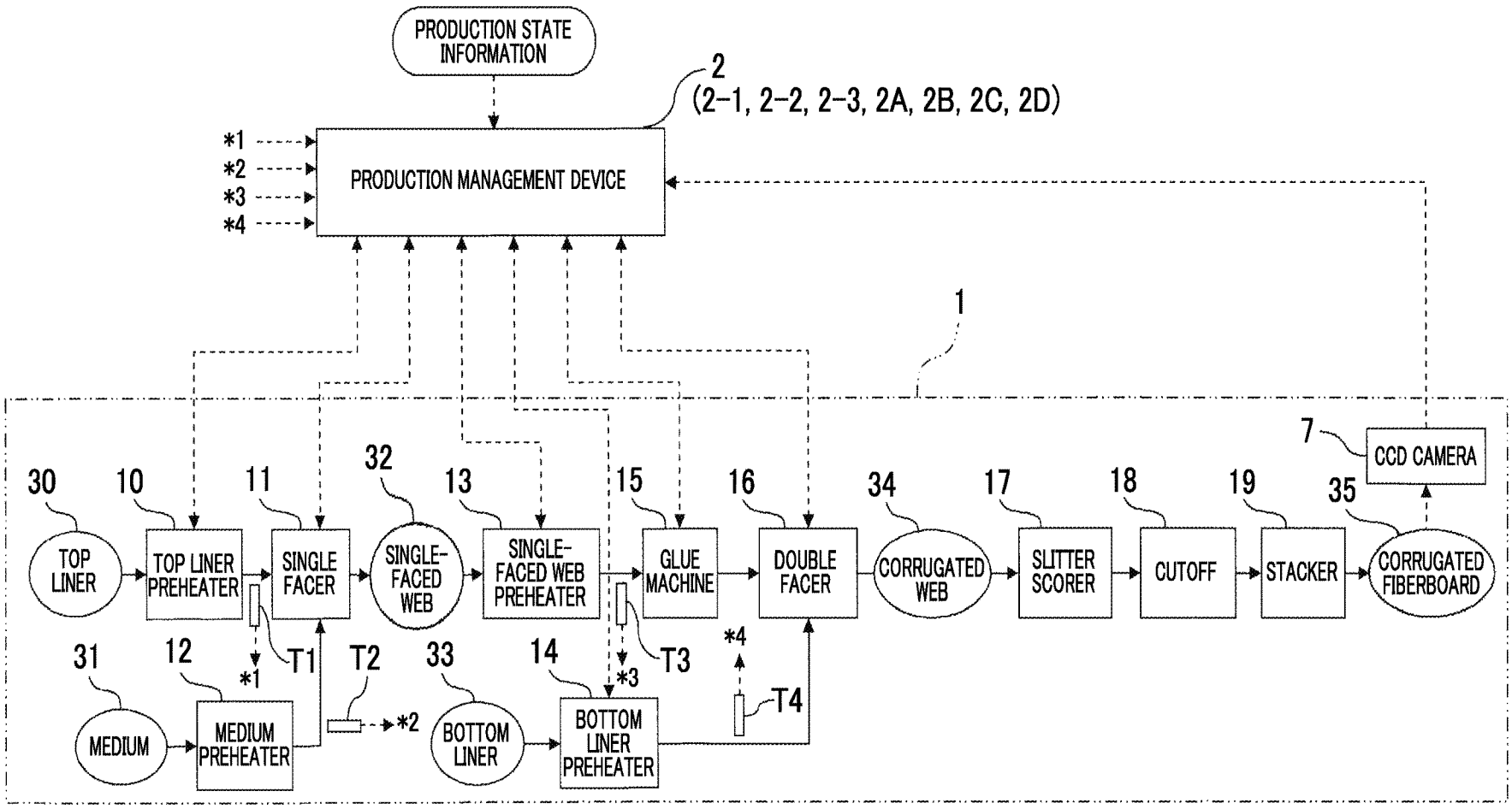
FIG. 1 is a diagram showing an outline of a corrugated fiberboard sheet manufacturing system according to each embodiment of the present invention.

Thus, first, a configuration of a corrugated fiberboard manufacturing device 1 common to the respective embodiments will be described with reference to FIG. 1.

The corrugated fiberboard manufacturing device 1 includes, as main configuration devices, a top liner preheater 10, a single facer 11, a medium preheater 12, a single-faced web preheater 13, a bottom liner preheater 14, a glue machine 15, a double facer 16, a slitter scorer 17, a cutoff 18, a stacker 19, and a CCD camera 7.

The top liner preheater 10 heats a top liner 30, and the medium preheater 12 heats a medium 31.

The single facer 11 rolls the medium 31 heated by the medium preheater 12 to apply adhesive, and attaches the top liner 30 heated by the top liner preheater 10 thereto.

The single-faced web preheater 13 heats a single-faced web 32 formed by the single facer 11, and the bottom liner preheater 14 heats a bottom liner 33.

The glue machine 15 applies adhesive to the single-faced web 32 heated by the single-faced web preheater 13.

The double facer 16 forms a corrugated web 34 by attaching the bottom liner 33 heated by the bottom liner preheater 14 to the single-faced web 32 to which adhesive is applied by the glue machine 15.

The slitter scorer 17 performs creasing or cutting onto the corrugated web 34 formed by the double facer 16 along a transfer direction, and the cutoff 18 cuts the corrugated web 34 creased by the slitter scorer 17 in a paper width direction to make a corrugated fiberboard 35, which is an end product.

The stacker 19 stacks the corrugated fiberboard 35 in order of completion.

The CCD camera 7 images the corrugated fiberboard 35 stacked by the stacker 19.

In addition, temperature sensors T1, T2, T3, and T4 (temperature acquisition means) that detect temperatures of the top liner 30 heated by the top liner preheater 10, the medium 31 heated by the medium preheater 12, the single-faced web 32 heated by the single-faced web preheater 13, and the bottom liner heated by the bottom liner preheater 14 respectively are included.

Herein, the top liner 30, the medium 31, the single-faced web 32, and the bottom liner 33 correspond to base paper of the present invention. Hereinafter, in a case of not differentiating therebetween, the top liner, the medium, the single-faced web, and the bottom line will be referred to as base paper 30 to 33.

[2. First Embodiment]

[2-1. Configuration]

Figure 2:
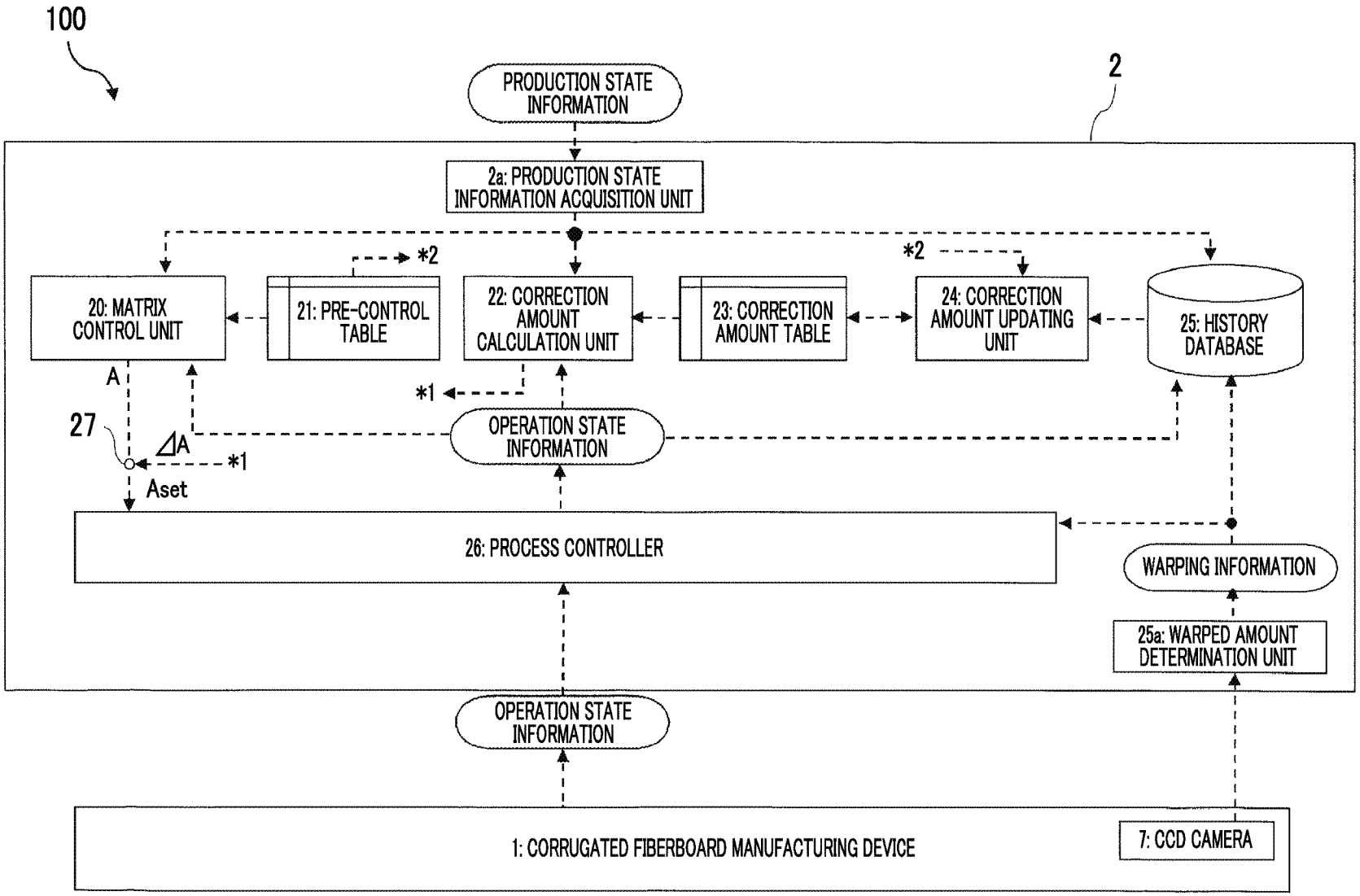
FIG. 2 is a schematic diagram showing a configuration of a corrugated fiberboard sheet manufacturing system according to a first embodiment of the present invention.

A first embodiment of the present invention will be described with reference to FIG. 2. A corrugated fiberboard sheet manufacturing system 100 of the embodiment is configured with the corrugated fiberboard manufacturing device 1 and a production management device 2.

The production management device 2 includes a production state information acquisition unit 2*a* (production state information acquisition means) that acquires production state information, such as a paper width, a basis weight, and a flute of base paper, from a higher-level production management system (not shown). By controlling each of the configuration devices of the corrugated fiberboard manufacturing device 1 as appropriate based on the acquired production state information, the production management device 2 creates the corrugated fiberboard 35 while suppressing the warping of the corrugated fiberboard 35. In a case of paying attention to a warping suppressing function, the production management device 2 is configured by including a matrix control unit 20, a pre-control table 21, a correction amount calculation unit 22, a correction amount table 23 (correction table), a correction amount updating unit 24 (updating means), a history database 25 (storage means), a warped amount determination unit 25*a*, a process controller 26, and an addition unit 27 (addition means).

The process controller 26 comprehensively controls the corrugated fiberboard manufacturing device 1. Specifically, when a new order starts, the process controller 26 performs feedforward-control onto each control element by using an initial control value Aset acquired from the addition unit 27 to be described later. After then, the process controller 26 acquires warping information, which is information of a sheet warped amount of the corrugated fiberboard 35, from the corrugated fiberboard manufacturing device 1, and feedback-controls each control element such that the sheet warped amount falls into a predetermined range based on the information.

Each control element for causing the sheet warped amount to fall into the predetermined range may be manually adjusted by an operator, in addition to feedback control by the process controller 26 or instead of the feedback control.

In addition, the process controller 26 acquires operation state information from the corrugated fiberboard manufacturing device 1, and outputs the operation state information to the matrix control unit 20, the correction amount calculation unit 22, or the history database 25, which is to be described later. The operation state information is an actual control value of a control element of the corrugated fiberboard manufacturing device 1.

As described above, the process controller 26 configures control means and control value information acquisition means of the present invention.

The pre-control table 21 is a table in which a standard control value A of the control element is stored, and is prepared for each of a plurality of different operation states (a plurality of different production speeds in the embodiment) with respect to each control element.

Herein, the control element refers to a controllable element affecting the warping of the corrugated fiberboard 35, and is, for example, each winding angle of the top liner preheater 10, the medium preheater 12, the single-faced web preheater 13, and the bottom liner preheater 14, each gap amount of the single facer 11 and the glue machine 15, or a pressurizing force of the double facer 16. In addition, in a case where a shower device applying moisture to base paper is included, also a moisture application amount is a control element. In the following description, in a case of not differentiating between respective winding angles of the top liner preheater 10, the medium preheater 12, the single-faced web preheater 13, and the bottom liner preheater 14, the winding angles will be referred to as preheater winding angles, and the preheater winding angles will be described as examples of the control element.

An example of the pre-control table 21 is shown in Table 1 below. In the example, the pre-control table 21 is a two-dimensional table in which the standard control value A of the preheater winding angle [degree] is set based on a basis weight [g/m$^2$] and a paper width [mm] of base paper. "A to B" in Table 1 below and subsequent Table 3 corresponding thereto means "A or more and less than B". For example, "100 to 200" means "100 or more and less than 200".

TABLE 1

| | | Basis weight | | | |
|---|---|---|---|---|---|
| | | 100~200 | 200~300 | 300~400 | 400~500 |
| Paper width | 100~200 | A1 | A2 | A3 | A4 |
| | 200~300 | A5 | A6 | A7 | A8 |
| | 300~400 | A9 | A10 | A11 | A12 |

The matrix control unit 20 acquires operation state information and production state information, and acquires the standard control value A of each control element according to the production state information with reference to the pre-control table 21 corresponding to the operation state information. If the control element is the preheater winding angle, the matrix control unit 20 acquires, according to the pre-control table 21, which is Table 1, a control value A1 as the standard control value A, for example, in a case where a basis weight is 150 and a paper width is 150.

The matrix control unit 20 outputs the standard control value A of each acquired control element to the addition unit 27 to be described later.

The warped amount determination unit 25*a* acquires image information of the corrugated fiberboard 35 from the CCD camera 7, and determines a sheet warped amount based on the image information. Warping information acquisition means of the present invention is configured with the CCD camera 7 and the warped amount determination unit 25*a*.

The history database 25 acquires production state information and warping information, and stores, as one actual data set, a data set including at least production state information, control value information, and warping information of each control element when a sheet warped amount has become minimum due to feedback control by the process controller 26 or manual adjustment by an operator in one time of order.

Table 2 below is given as an example of the history database 25. Table 2 below shows only a winding angle of a preheater as control value information of a control element for the sake of convenience. Winding angles Aact1 to Aact5 are actual winding angles of the preheater, which are obtained as a result of the process controller 26 feedback-controlling a sheet warped amount such that an increase in the sheet warped amount is suppressed or as a result of manual adjustment by the operator.

TABLE 2

| | Production state information | | Control value | Warped amount |
|---|---|---|---|---|
| | Basis weight | Paper width | (preheater winding angle) | (warp factor) |
| Actual data set 1 | 100 | 100 | Aact1 | 0.5 |
| Actual data set 2 | 120 | 150 | Aact2 | 0.6 |
| Actual data set 3 | 160 | 190 | Aact3 | 0.4 |

TABLE 2-continued

| | Production state information | | Control value | Warped amount |
|---|---|---|---|---|
| | Basis weight | Paper width | (preheater winding angle) | (warp factor) |
| Actual data set 4 | 190 | 220 | Aact4 | 0.2 |
| Actual data set 5 | 210 | 250 | Aact5 | 0.3 |

The correction amount table 23 is a table for setting a correction amount ΔA of the standard control value A stored in the pre-control table 21. The correction amount ΔA is an adjustment amount of the standard control value A stored in the pre-control table 21, and is a negative number, zero, or a positive number.

Just as the pre-control table 21, the correction amount table 23 is prepared for each of the plurality of different operation states (the plurality of different production speeds in the embodiment) with respect to each control element. An example of the correction amount table 23 is shown in Table 3 below. In the example, the correction amount table 23 is a two-dimensional table in which the correction amount ΔA of a preheater winding amount is set based on a basis weight and a paper width of base paper. For example, when the basis weight is 150 and the paper width is 150, a correction amount ΔA1 is selected as the correction amount ΔA.

TABLE 3

| | | Basis weight | | | |
|---|---|---|---|---|---|
| | | 100~200 | 200~300 | 300~400 | 400~500 |
| Paper width | 100~200 | ΔA1 | ΔA2 | ΔA3 | ΔA4 |
| | 200~300 | ΔA5 | ΔA6 | ΔA7 | ΔA8 |
| | 300~400 | ΔA9 | ΔA10 | ΔA11 | ΔA12 |

The correction amount updating unit 24 updates the correction amount table 23 based on the actual data set recorded in the history database 25. The correction amount updating unit 24 acquires a structure of a table from the correction amount table 23. When the correction amount table 23 is a table in Table 3, a structure of 3 rows×4 columns (=12 cells), which is formed of three rows of "100 to 200", "200 to 300", and "300 to 400" in terms of a paper width and four columns of "100 to 200", "200 to 300", "300 to 400", and "400 to 500" in terms of a basis weight, is acquired.

To describe an example in a case where an update target cell is a cell having a paper width of "100 to 200" and a basis weight of "100 to 200", the correction amount updating unit 24 extracts, from the history database 25, an actual data set having a paper width in a range of "100 to 200", a basis weight in a range of "100 to 200", and a minimum warped amount, and extracts an actual data set 3 in an example shown in Table 2.

The correction amount updating unit 24 acquires, from the pre-control table 21, the standard control value A corresponding to the update target cell of the correction amount table 23, and acquires the control value A1 as the standard control value A from the cell having a paper width of "100 to 200" and a basis weight of "100 to 200" in an example of Table 1. A value of the correction amount ΔA1 of the update target cell is updated based on a difference between the control value A1 and a control value Aact3 which is a control value of the actual data set 3 (=Aact3−A1).

The correction amount calculation unit 22 acquires the correction amount ΔA for each control element from an appropriate cell of the correction amount table 23 based on production state information and operation state information, and outputs the correction amount ΔA to the addition unit 27.

The addition unit 27 outputs, for each control element, a value obtained by adding the correction amount ΔA acquired from the correction amount calculation unit 22 to the standard control value A acquired from the matrix control unit 20 to the process controller 26 as the initial control value Aset (initial control value Aset=standard control value A+correction amount ΔA).

[2-2. Control Flow]

Figure 3:
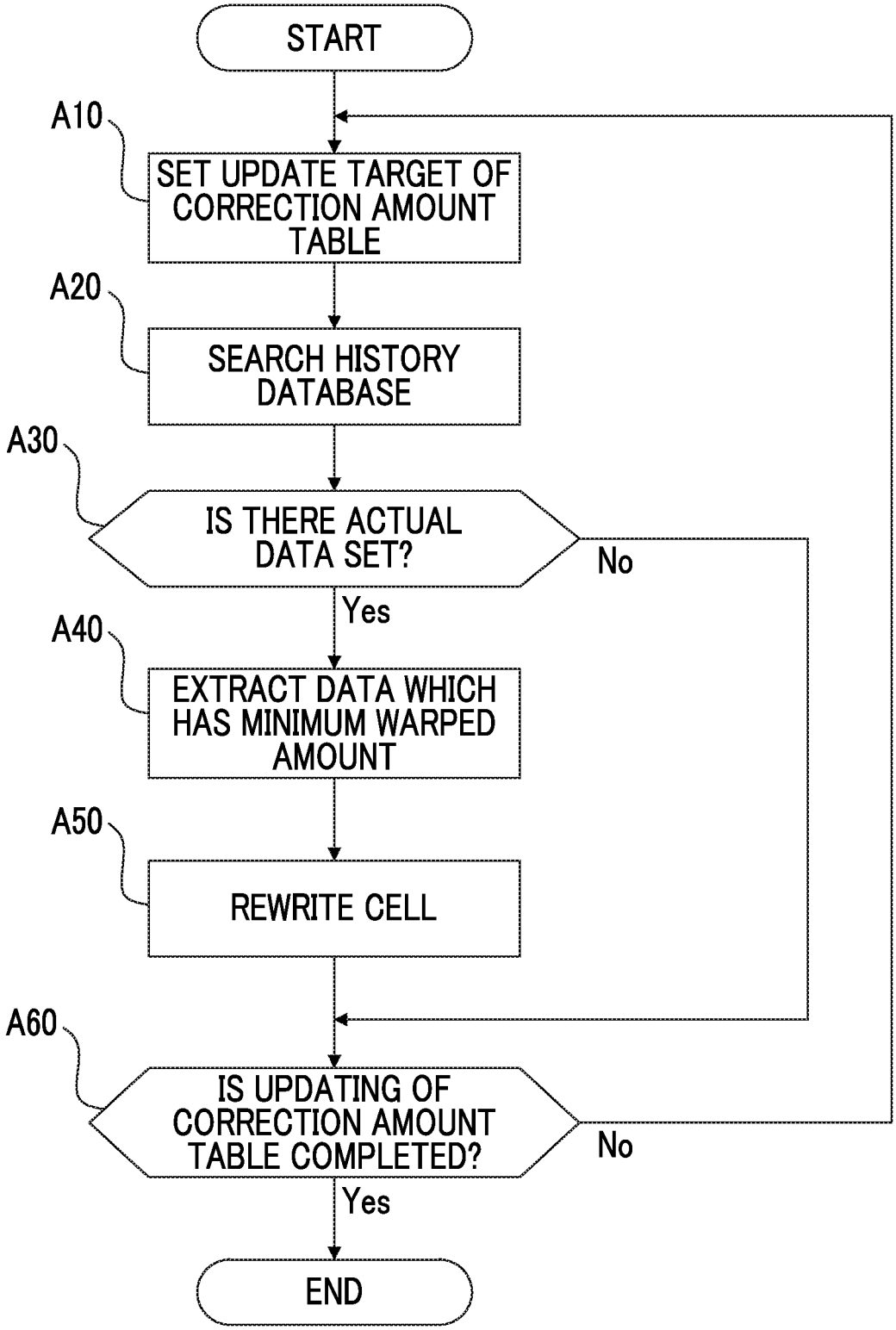
FIG. 3 shows schematic control flow for describing updating control of a correction amount table according to the first embodiment of the present invention.

Hereinafter, control flow of updating control will be described with reference to FIG. 3 with the correction amount table 23 for a preheater winding angle, which is Table 3, given as an example. In anticipation of time when a certain amount of new actual data sets are accumulated in the history database 25, the control flow is executed, and is repeatedly executed, for example, on a daily basis or on a weekly basis.

First, in Step A10, a cell to become an update target of the correction amount table 23 is set from the twelve cells. In the embodiment, three cells respectively having paper widths of "100 to 200", "200 to 300", and "300 to 400", which correspond to specifications of paper types of various sheet materials prepared in a production plan, for example, a basis weight of "100 to 200", are set in turn. In Step A20, the history database 25 is searched. In Step A30, the presence or absence of an actual data set, which is in a range of a basis weight that is the same as the cell to become the update target and in a range of a paper width that is the same as the cell to become the update target, is determined. When there is a corresponding actual data set, processing proceeds to Step A40, and when there is no corresponding actual data set, processing proceeds to Step A60.

In Step A40, out of the corresponding actual data sets, an actual data set, in which a sheet warped amount is minimum, is extracted. In Step A50, a numerical value of the corresponding cell is rewritten based on a control value of a preheater winding angle included in the actual data set.

In Step A60, whether or not updating control of a correction amount is completed for all of the three cells to become the update targets in the correction amount table 23 is determined (a case where rewriting is not performed since there is no corresponding actual data set is also included). In a case where updating control of a correction amount is completed for all of the cells, the update of the correction amount table 23 is terminated. In a case otherwise, after returning to Step A10 and the cells to become the update targets are changed, Step A20 and steps thereafter are executed.

[2-3. Operation and Effect]

In the embodiment, an actual data set that includes at least production state information, control value information, and warping information is stored in the history database 25, and from the actual data set stored in the history database 25, the correction amount table 23 is updated based on a control value having a good sheet warped amount. That is, the correction amount table 23 is updated based on an actual value such that an increase in a sheet warped amount can be further suppressed.

After then, in the same production state, the standard control value A of a preheater winding angle stored in the pre-control table 21 is corrected through the correction amount ΔA obtained from the updated correction amount table 23, and the initial control value Aset is set.

As a result, after then, in the same production state, since the initial control value Aset of a control value is set in accordance with the correction amount table 23 updated based on the actual value, the preheater winding angle can be quickly optimized by feedback control or manual adjustment by an operator, and the warping of a corrugated fiberboard can be quickly rectified.

In addition, with respect to the standard control value A of the pre-control table 21, the correction amount ΔA based on an actual value for suppressing a sheet warped amount is stored into the correction amount table 23. That is, since it is possible to manage an extent that the standard control value A deviates from an optimal control value, for example, it is possible to achieve optimization of the standard control value A in a production state where there is no actual value by analyzing a cause of this deviation.

[2-4. Modification Example]

[2-4-1. First Modification Example]

A first modification example of the first embodiment of the present invention will be described with reference to FIG. 4. A corrugated fiberboard sheet manufacturing system 100-1 of the modification example is configured with the corrugated fiberboard manufacturing device 1 and a production management device 2-1.

Figure 4:
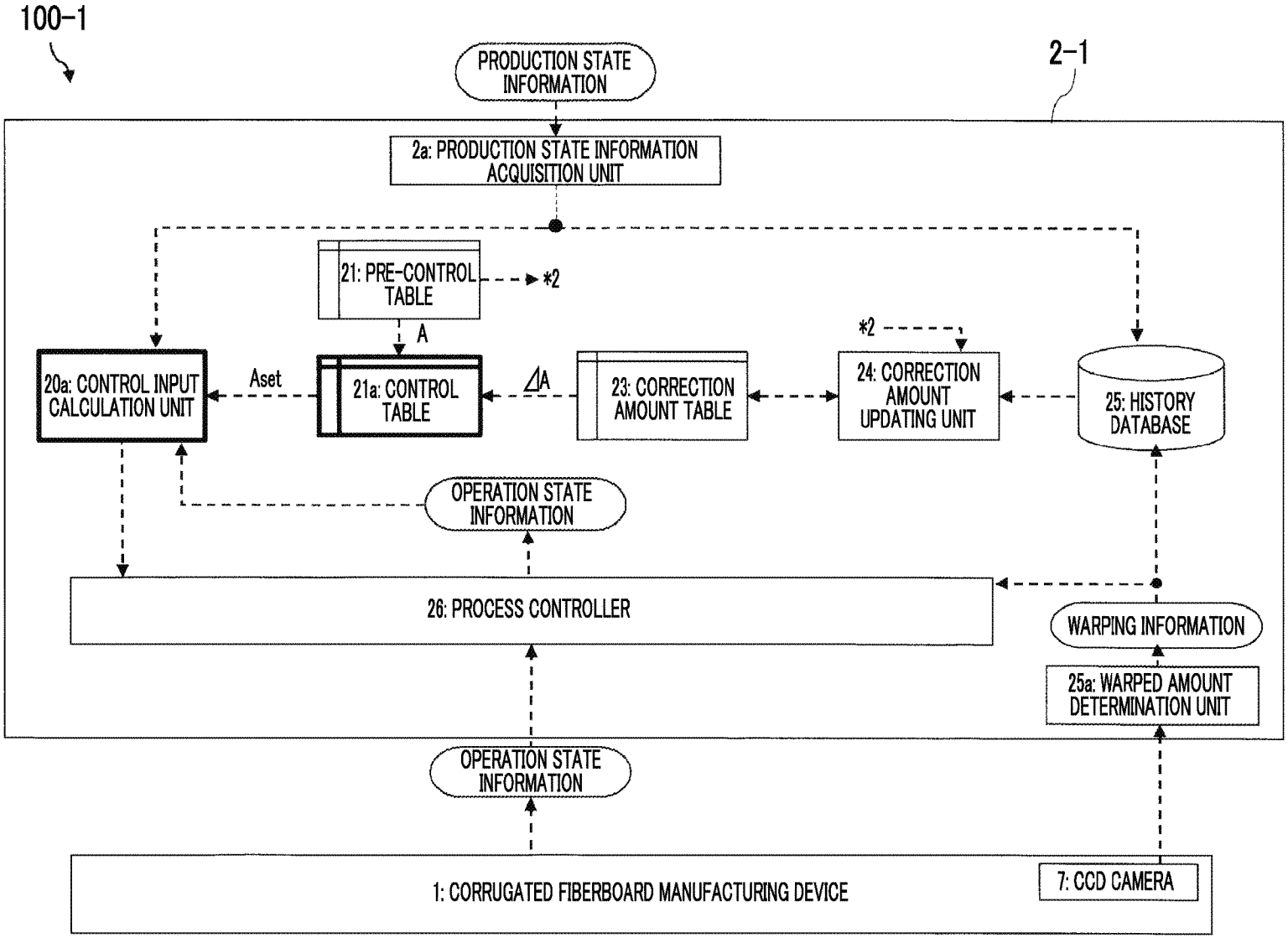
FIG. 4 is a schematic diagram showing a configuration of a corrugated fiberboard sheet manufacturing system according to a first modification example of the first embodiment of the present invention.

As shown in FIG. 4, portions indicated with bold frames in the production management device 2-1 of the modification example are different from the first embodiment. In the modification example, a control table **21*a* is added to the first embodiment, and a control input calculation unit 20*a* is provided instead of the matrix control unit 20**. Since other configuration elements are the same as the first embodiment, the same reference signs as the first embodiment will be assigned, and description thereof will be omitted.

The control table **21*a* is used in setting the initial control value Aset according to a production state, and has the same structure as the pre-control table 21 (refer to Table 1). At the time of initial operation start of the corrugated fiberboard sheet manufacturing system, the standard control value A stored in the corresponding cell of the pre-control table 21 is input as it is in each cell of the control table 21*a* as the initial control value Aset. In other words, the control table 21*a* is a duplicate of the pre-control table 21** at the time of initial operation start.

When the correction amount table 23 is updated, the control table **21*a* acquires the correction amount ΔA of a rewritten cell in the correction amount table 23, acquires the standard control value A stored in a cell corresponding to this cell from the pre-control table 21**, and adds the correction amount ΔA and the standard control value A to update the corresponding cell.

As described above, the initial control value Aset is set by correcting the standard control value A through the control table **21*a* and the correction amount table 23, and the control table 21*a*** and the correction amount table correspond to a correction table of the present invention.

The control input calculation unit **20*a* acquires operation state information and production state information. With reference to the control table 21*a* corresponding to the operation state information, the control input calculation unit acquires the initial control value Aset of each control element corresponding to the production state information, and outputs the initial control value Aset to the process controller 26**.

[2-4-2. Second Modification Example]

A second modification example of the first embodiment of the present invention will be described with reference to FIG. 5. A corrugated fiberboard sheet manufacturing system 100-2 of the modification example is configured with the corrugated fiberboard manufacturing device 1 and a production management device 2-2.

Figure 5:
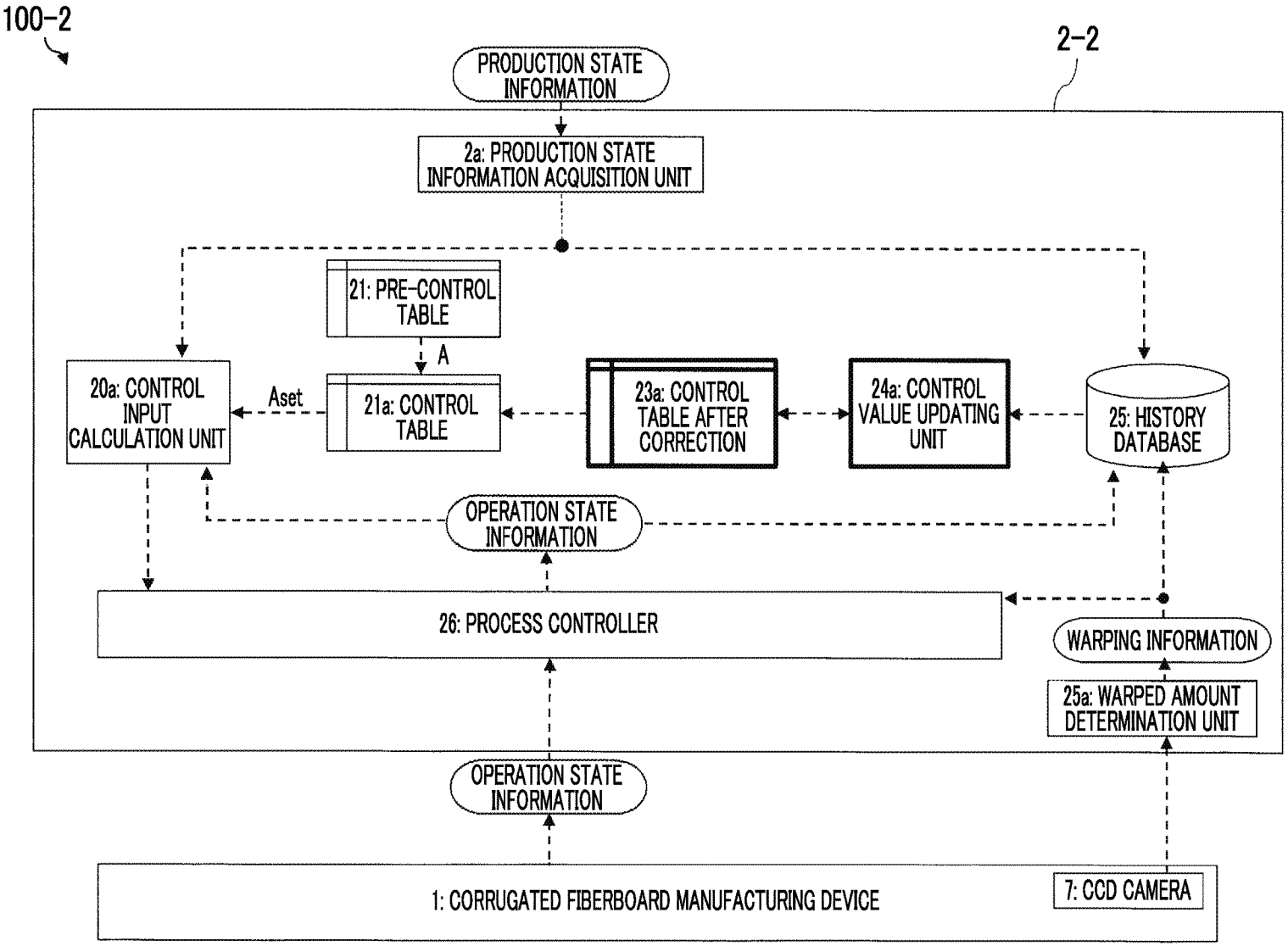
FIG. 5 is a schematic diagram showing a configuration of a corrugated fiberboard sheet manufacturing system according to a second modification example of the first embodiment of the present invention.

As shown in FIG. 5, portions indicated with bold frames of the production management device 2-2 of the modification example are different from the first modification example. That is, in the modification example, instead of the correction amount table 23 and the correction amount updating unit 24, a control table after correction 23*a* and a control value updating unit 24*a* are additionally provided compared to the first modification example. Since other configuration elements are the same as the first modification example, the same reference signs as the first modification example will be assigned, and description thereof will be omitted.

The control value updating unit 24*a* updates the control table after correction 23*a* based on history recorded in the history database 25. Specifically, after acquiring a structure of a table from the control table after correction 23*a*, the control value updating unit 24*a* extracts an actual data set, which belongs to a predetermined production state and has a minimum warped amount, from the history database 25, and updates a cell to become an update target of the control table after correction 23*a* with a preheater winding angle of the actual data set (update value).

The control table after correction 23*a* is used in setting the initial control value Aset. When a control value is updated by the control value updating unit 24*a*, the control table after correction outputs the control value after correction, which is stored in the updated cell, to the control table 21*a*. In the control table 21*a*, the initial control value Aset stored in a cell corresponding thereto is updated with the control value input from the control table after correction 23*a*.

The initial control value Aset is set by correcting the standard control value A through the control table 21*a* and the control table after correction 23*a*, and the control table 21*a*, the control table after correction 23*a*, and the control value updating unit 24*a* correspond to the correction table of the present invention.

Figure 6:
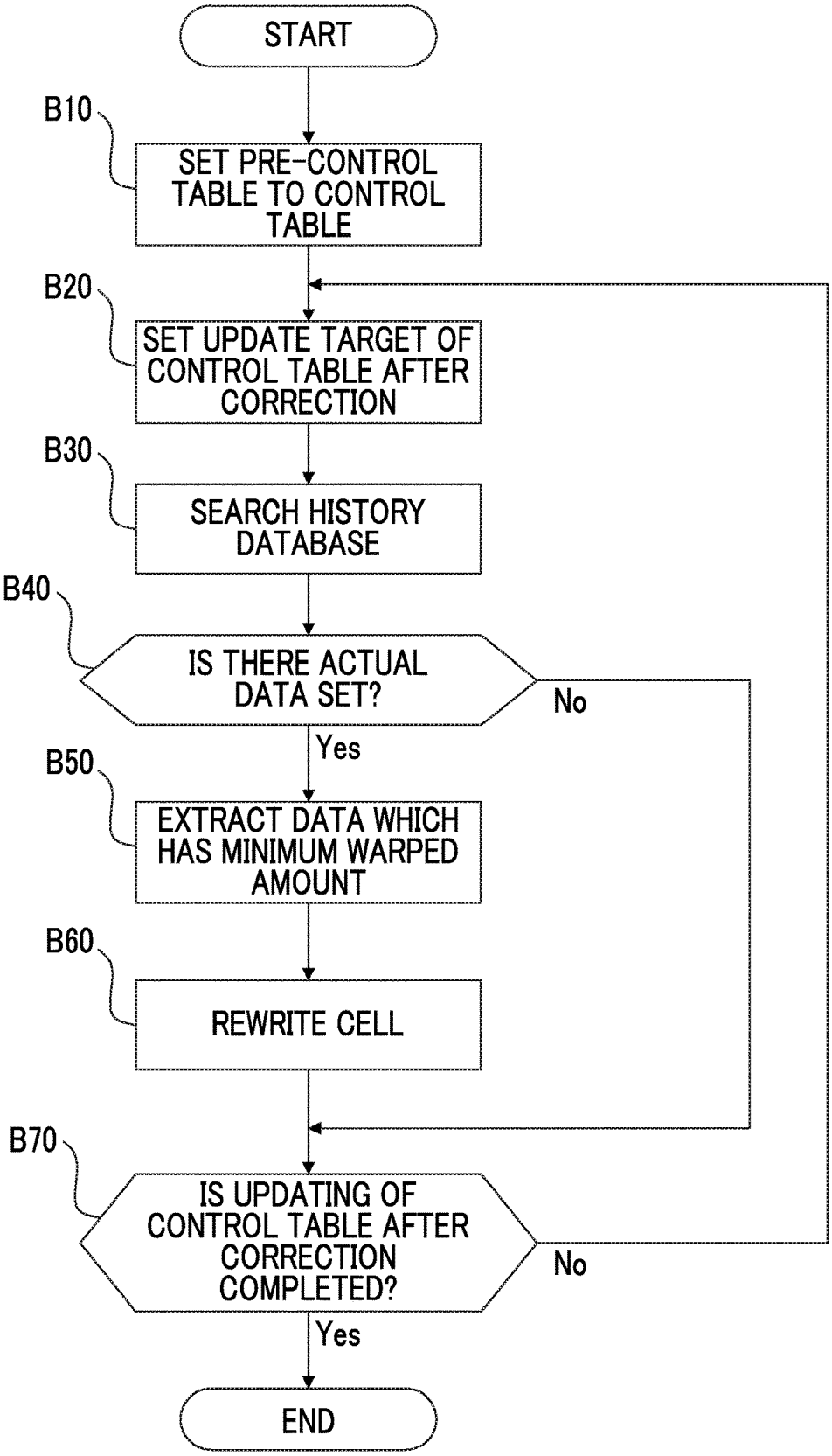
FIG. 6 shows schematic control flow for describing updating control of a control table after correction according to the second modification example of the first embodiment of the present invention.

Hereinafter, control flow of updating control of the control table after correction 23*a* according to the modification example will be described with reference to FIG. 6. Just as the control flow of the control table after correction 23*a* of the first embodiment, in anticipation of time when a new actual data set is accumulated in the history database 25, this control flow is executed, and is repeatedly executed, for example, on a daily basis or on a weekly basis.

First, in Step B10, at the time of initial operation of the corrugated fiberboard sheet manufacturing system, a control value input in the pre-control table 21 is input as it is into the control table 21*a*. Next, in Step B20, a cell to become an update target of the control table after correction 23*a* is set. In the modification example, cells corresponding to specifications of paper types of various sheet materials prepared in the production plan are set in turn. In Step B30, the history database 25 is searched if there is an actual data set corresponding to the cell. In Step B40, the presence or absence of a corresponding actual data set is determined. When there is the corresponding actual data set, processing proceeds to Step B50, and when there is no corresponding actual data set, processing proceeds to Step B70.

In Step B50, out of the corresponding actual data sets, an actual data set, in which a sheet warped amount is minimum, is extracted. In Step B60, a control value of a corresponding cell is updated based on a preheater winding angle in the actual data set in which the sheet warped amount is minimum, and processing proceeds to Step B70. In Step B70, whether or not updating control of a control value is completed for all of cells to become update targets in the control table after correction 23*a* is determined. In a case where updating control of a control value for all of cells is completed, the update of the control table after correction 23*a* is terminated. In a case otherwise, after processing returns to Step B20 and a cell to become an update target is changed, Step B30 and steps thereafter are executed.

When the update of the control table after correction 23*a* is completed, update of corresponding cells of the control table 21*a* is performed based on numerical values stored in the cells updated in the control table after correction 23*a*.

[2-4-3. Third Modification Example]

A third modification example of the first embodiment of the present invention will be described with reference to FIG. 7. A corrugated fiberboard sheet manufacturing system 100-3 of the modification example is configured with the corrugated fiberboard manufacturing device 1 and a production management device 2-3.

Figure 7:
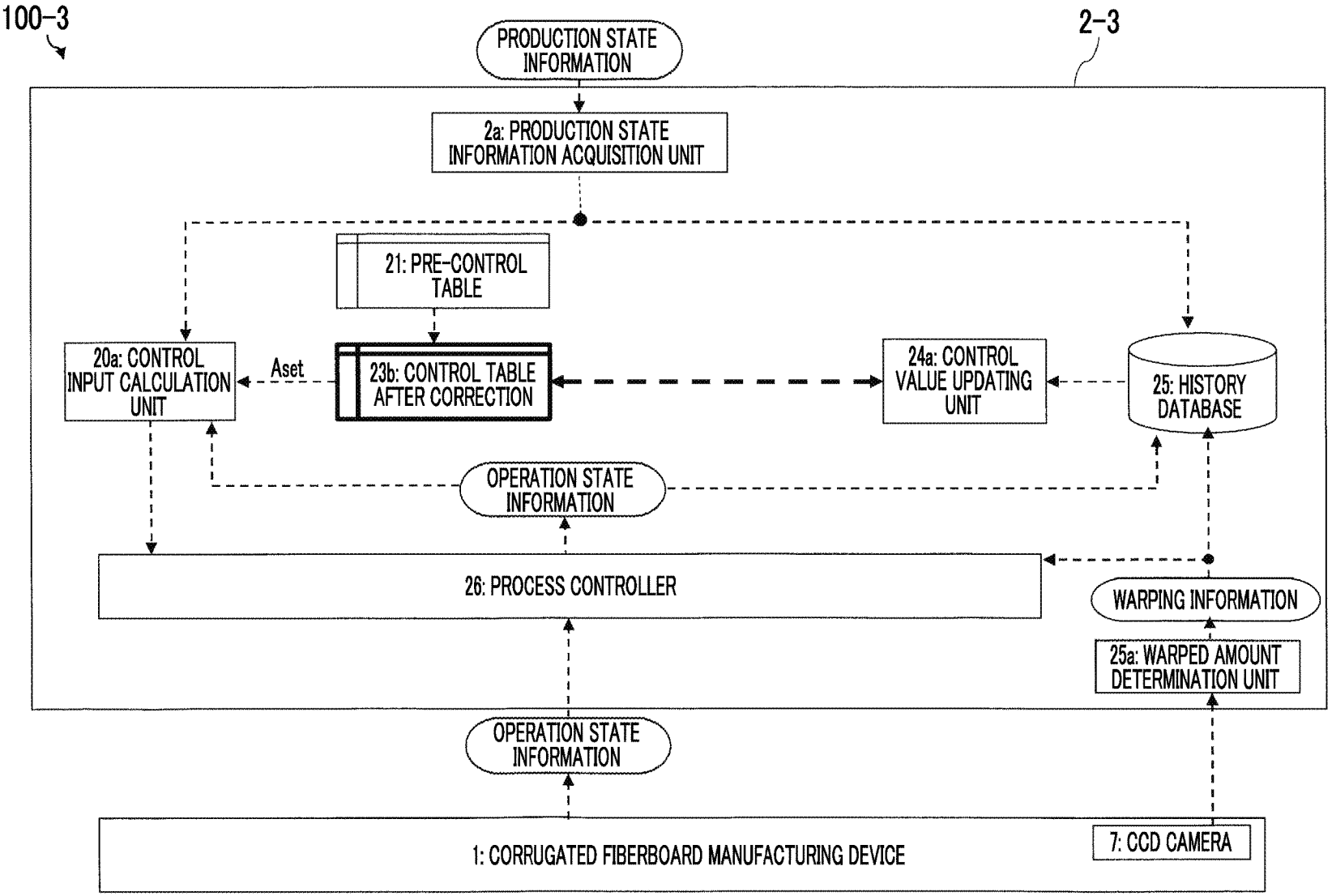
FIG. 7 is a schematic diagram showing a configuration of a corrugated fiberboard sheet manufacturing system according to a third modification example of the first embodiment of the present invention.

As shown in FIG. 7, a portion indicated with a thick line of the production management device 2-3 of the modification example is different from the second modification example shown in FIG. 5. That is, the control table 21*a* is omitted, and a control table after correction 23*b* is provided instead of the control table after correction 23*a*. Since other configuration elements are the same as the second modification example, the same reference signs as the second modification example will be assigned, and description thereof will be omitted.

The control table after correction 23*b* is a table obtained by integrating with the control table 21*a* and the control table after correction 23*a* of the second modification example. Specifically, at the time of initial operation start of the corrugated fiberboard sheet manufacturing system, the standard control value A stored in a corresponding cell of the pre-control table 21 is stored as it is in each cell of the control table after correction 23*b* as the initial control value Aset. Other points are the same as the control table after correction 23*a* of the second modification example, and the control table after correction 23*b* corresponds to the correction table of the present invention.

[2-5. Others]

When temperatures of the base paper 30 to 33 are equal to or lower than a predetermined temperature, there is a possibility that defective attachment occurs. In the first embodiment and the first modification example to the third modification example, when temperatures detected by the temperature sensors T1 to T4 detecting temperatures of the base paper 30 to 33 are less than a threshold temperature, production state information or a sheet warped amount of that time may not be stored in the history database 25 as an actual data set. Alternatively, the temperatures of the base paper 30 to 33 are incorporated as information data configuring an actual data set. The correction amount updating unit 24 and the control value updating unit 24*a* may not be used in updating the correction amount table 23 or the control table after corrections 23*a* and 23*b* as for the actual data sets in which the temperatures of the base paper 30 to 33 are less than the threshold temperature.

[3. Second Embodiment]

[3-1. Configuration of Production Management Device]

A second embodiment of the present invention will be described with reference to FIGS. 8 and 9. A corrugated fiberboard sheet manufacturing system 100A of the embodiment is configured with the corrugated fiberboard manufacturing device 1 and a production management device 2A.

Figure 8:
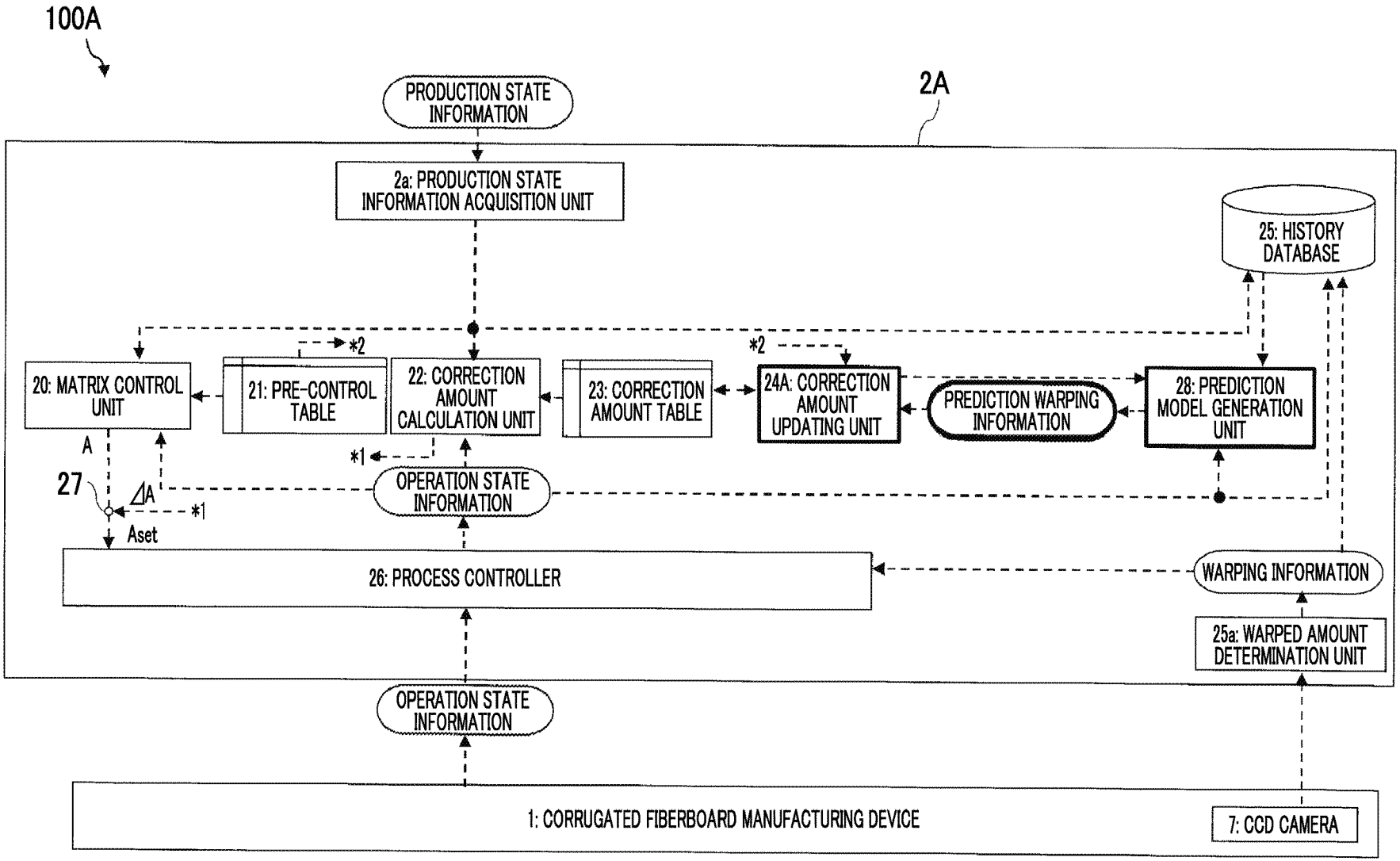
FIG. 8 is a schematic diagram showing a configuration of a corrugated fiberboard sheet manufacturing system according to a second embodiment of the present invention.
Figure 9:
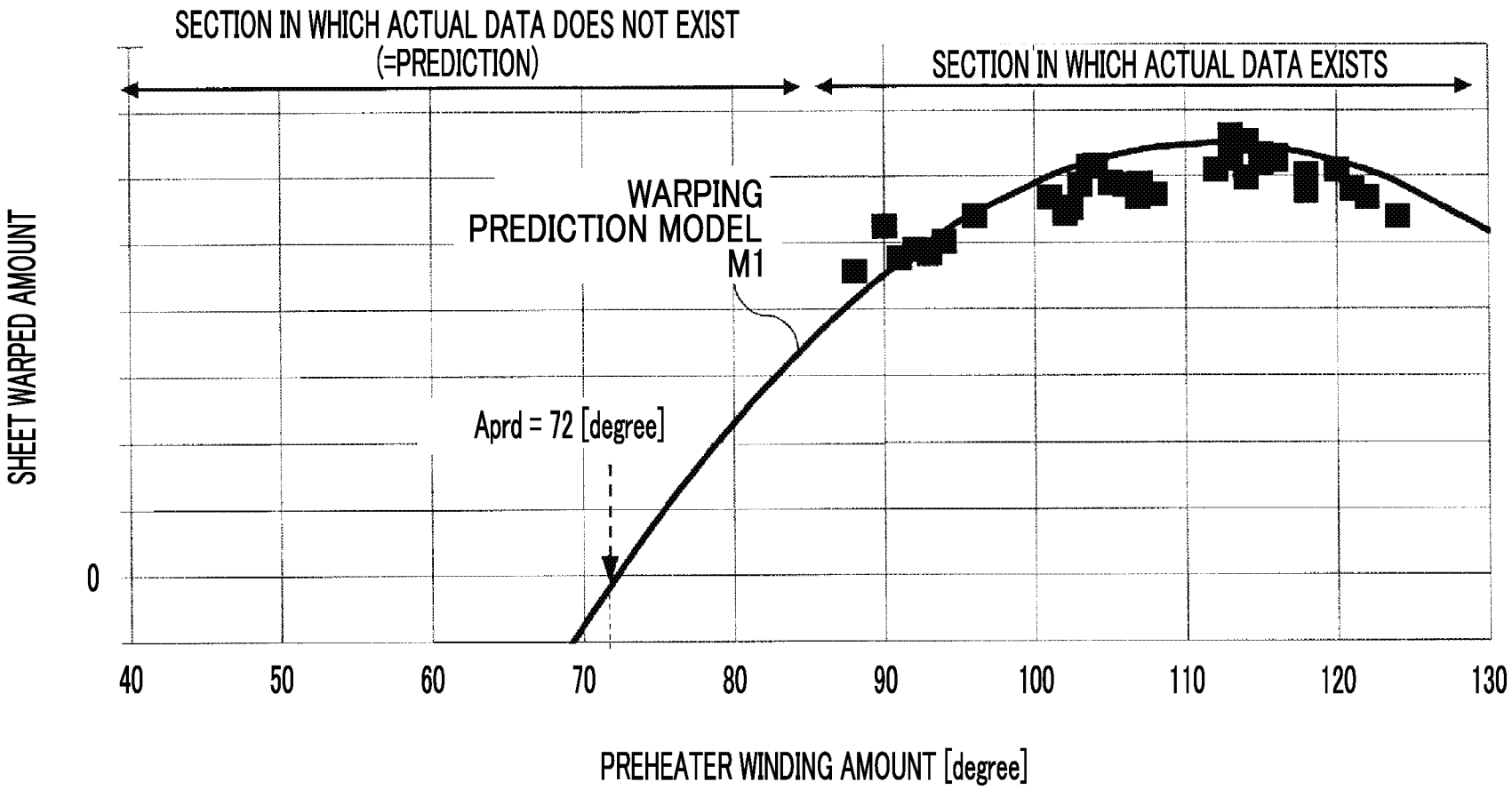
FIG. 9 is a schematic diagram for describing a warping prediction model according to the second embodiment of the present invention.

As shown in FIG. 8, portions indicated with bold frames of the production management device 2A of the embodiment are different from the first embodiment. That is, the embodiment is partially different from the first embodiment in terms of functions of a correction amount updating unit 24A, and a prediction model generation unit 28 is added. Since other configuration elements are the same as the first embodiment, the same reference signs as the first embodiment will be assigned, and description thereof will be omitted.

The correction amount updating unit 24A is the same as the correction amount updating unit 24 of the first embodiment in that the correction amount table 23 is updated based on an actual data set recorded in the history database 25, outputs a cell to become an update target to the prediction model generation unit 28, and requests the prediction model generation unit 28 (first prediction model generation means) to generate a warping prediction model M1 of a preheater winding angle in the cell.

The prediction model generation unit 28 creates the warping prediction model M1 for the update target cell, which is requested from the correction amount updating unit 24A, based on the actual data set acquired from the history database 25, and stores the warping prediction model M1.

The correction amount updating unit 24A acquires an optimal preheater winding angle Aprd, at which a warped amount of the corrugated fiberboard 35 in the cell to become the update target is equal to or less than a predetermined value, by using the warping prediction model M1, and sets a difference between the standard control value A acquired from the pre-control table 21 and the optimal preheater winding angle Aprd (=Aprd−A) as a new correction amount to update a value of the correction amount ΔA of the update target cell.

The correction amount calculation unit 22, the correction amount updating unit 24A, and the prediction model generation unit 28 will be further described with reference to FIG. 9 with a preheater winding angle [degree] given as an example.

When the update target cell has a paper width of "100 to 200" and a basis weight of "100 to 200", the prediction model generation unit 28 acquires an actual data set, in which the paper width and the basis weight are in the ranges, from the history database 25. The warping prediction model M1 that is a regression model, through which a warped amount of the corrugated fiberboard 35 is acquired from a preheater winding angle, is generated from actual data sets (operation data) indicated with filled squares in FIG. 9. The warping prediction model M1 may be a statistical model such as a vicinity search model and a regression tree, or may be a physical model. In a case of using a statistical model, a warped amount may be directly acquired from an actual data set acquired from the history database 25. In a case of using a physical model, an adjustment parameter is fitted such that a prediction result obtained through the physical model agrees an actual data set.

Through the warping prediction model M1, the correction amount updating unit 24A acquires the optimal preheater winding angle Aprd at which a warped amount is ideal. In an example shown in FIG. 9, 72 [degree] at which a sheet warped amount is zero is set as the optimal preheater winding angle Aprd.

In a case where a production state continuously changes just as a basis weight, it is considered that the correction amount calculation unit 22 changes, according to a basis weight, the correction amount ΔA of a control element exemplified as a preheater winding angle continuously or in a piecemeal manner. For example, it is considered that the correction amount ΔA is set for 10 [g/m$^2$] by linearly interpolating between the correction amount ΔA1 when the basis weight is 100 to 200 [g/m$^2$] and the correction amount ΔA2 when the basis weight is 200 to 300 [g/m$^2$], in a range of a basis weight of the correction amount table of Table 3 is 100 to 200 [g/m$^2$].

In such a case, the prediction model generation unit 28 generates the warping prediction model M1 for every 10 [g/m$^2$] basis weight. After acquiring each sheet warped amount at each linear interpolation point through the warping prediction models M1, the correction amount updating unit 24A may acquire the optimal preheater winding angle Aprd and update the correction amount table 23.

Specifically, the prediction model generation unit 28 generates the warping prediction model M1 for each of all of 11 points of 100, 110, 120, 130, . . . , 190, and 200 [g/m$^2$] in increments of a basis weight of 10 [g/m$^2$]. The correction amount updating unit 24A predicts sheet warped amounts for all of the 11 points based on the warping prediction model M1, and sets a preheater winding angle at which a total value of the sheet warped amounts of the 11 points is minimum, or a preheater winding angle at which a maximum value of the sheet warped amounts of the 11 points is minimum as the optimal preheater winding angle Aprd. Then, the correction amount updating unit 24A uses the optimal preheater winding angle Aprd to update the correction amount table 23.

For example, in a case of acquiring the correction amount ΔA when a basis weight is 150 [g/m$^2$], the correction amount calculation unit 22 acquires the correction amount ΔA1 when a basis weight is 100 to 200 [g/m$^2$] and the correction amount ΔA2 when a basis weight is 200 to 300 [g/m$^2$] from the correction amount table 23, and linearly interpolates the correction amounts ΔA1 and ΔA2 to acquire the correction amount ΔA when a basis weight is 150 [g/m$^2$].

[3-2. Operation and Effect]

(1) In the embodiment, even in a production state where there few actual data sets or an actual data set does not exist in the history database 25, a warped amount can be predicted by using the warping prediction model M1, and the warping of the corrugated fiberboard 35 can be suppressed.

(2) In the embodiment, since the correction amount table 23 is updated in particular, information shown in the pre-control table 21 can be utilized in correcting a control amount of a control element according to a change in production state information. Therefore, there is an advantage that the initial control value Aset can be accurately set by using the warping prediction model M1.

Hereinafter, the reason will be described by comparing the embodiment with a method of directly updating the pre-control table 21 (hereinafter, referred to as a "comparative example"). In addition to the embodiment, the comparative example as well will be described as a method of correcting the standard control value A specified in the pre-control table based on the same actual value data.

First, the comparative example will be described. For example, actual value data of a preheater winding angle shown in Table 4 below is obtained from the history database 25. In Table 4 below, a vertical line is a basis weight, and a horizontal line is a preheater winding angle. Numbers in cells indicate sheet warped amounts for corresponding basis weights and preheater winding angles, and blanks in cells indicate that there is no actual value data. For example, a sheet warped amount for a basis weight of 100 [g/m$^2$] and a preheater winding angle of 20 [degree] is 0.15, and actual value data of a sheet warped amount for a basis weight of 100 [g/m$^2$] and a preheater winding angle of 60 [degree] does not exist.

In addition, cells includes specific cells which correspond to the standard control values A specified as the initial control values Aset in a pre-control table before initial operation start (before update). The specific cells are basis weights 100, 150 intersecting preheater winding angle 20, basis weight 200 intersecting preheater winding angle 40, basis weight 250 intersecting preheater weight angle 100, and basis weight 300 intersecting preheater angle 120. That is, in the pre-control table, with respect to basis weights 100, 150, 200, 250, and 300 and [g/m$^2$], preheater winding angles 20, 20, 40, 100, and 120 [degree] are respectively set as the standard control values A.

TABLE 4

| | | Preheater winding angle [degree] | | | | | |
|---|---|---|---|---|---|---|---|
| Sheet warped amount | | 20 | 40 | 60 | 80 | 100 | 120 |
| Basis weight [g/m$^2$] | 100 | 0.15 | 0.05 | | | | |
| | 150 | 0.10 | 0.07 | | | | |
| | 200 | | 0.10 | 0.05 | | | |
| | 250 | | | | 0.25 | 0.20 | |
| | 300 | | | | | | 0.23 |

The warping prediction model M1 is prepared from actual value data of Table 4 through linear regression, and a sheet warped amount in which a basis weight and a preheater winding angle are without actual value data is predicted from the warping prediction model M1, and the predicted amount is shown in Table 5. Specific cells of Table 5 are cells in which sheet warped amounts are predicted from the warping prediction model M1. The specific cells are basis weights 200, 250 300 intersecting preheater winding angle 20, basis weights 250, 300 intersecting preheater winding angle 40, basis weights 100, 150, 250, 300 intersecting preheater weight angle 60, basis weights 100, 150, 200, 300 intersecting preheater angle 80, basis weights 100, 150, 200, 300 intersecting preheater weight angle 100, basis weights 100, 150, 200, 250, 300 intersecting preheater angle 120. In addition, from the prediction result, the initial control value Aset of the pre-control table 21 is updated from the standard control value A based on the optimal preheater winding angle Aprd having the smallest sheet warped amount for each basis weight in the specific cells. The specific cells are basis weights 250, 300 intersecting preheater winding angle 20, basis weights 100, 150 intersecting preheater winding angle 40, basis weight 200 intersecting preheater weight angle 60. That is, the pre-control table 21 is updated with preheater winding angles 40, 40, 60, 20, and 20 [degree] respectively set as the initial control values Aset with respect to basis weights 100, 150, 200, 250, and 300 [g/m$^2$].

TABLE 5

| | | Preheater winding angle [degree] | | | | | |
|---|---|---|---|---|---|---|---|
| Sheet warped amount | | 20 | 40 | 60 | 80 | 100 | 120 |
| Basis weight [g/m$^2$] | 100 | 0.15 | 0.05 | 0.09 | 0.10 | 0.12 | 0.13 |
| | 150 | 0.10 | 0.07 | 0.12 | 0.13 | 0.14 | 0.15 |
| | 200 | 0.11 | 0.10 | 0.05 | 0.15 | 0.16 | 0.18 |
| | 250 | 0.14 | 0.15 | 0.16 | 0.25 | 0.20 | 0.20 |
| | 300 | 0.16 | 0.18 | 0.19 | 0.20 | 0.21 | 0.23 |

The initial control values Aset before update and after update are organized in Table 6 below. As it is clear from Table 6 below as well, after making significant changes compared to the standard control values A before update, the initial control values Aset for basis weights of 250 and 300 [g/m$^2$] are smaller than the standard control values A of basis weights of 100 to 200 [g/m$^2$]. While the standard control value A, which is the initial control value Aset before update, is set by reflecting information that an optimal value of a preheater winding angle tends to increase as a basis weight increases, such information is not reflected in the initial control value Aset after update.

TABLE 6

| | Initial control value Aset of preheater winding angle [degree] | Before correction (= standard control value A) | After correction | Correction amount |
|---|---|---|---|---|
| Basis weight [g/m$^2$] | 100 | 20 | 40 | 20 |
| | 150 | 20 | 40 | 20 |
| | 200 | 40 | 60 | 20 |
| | 250 | 100 | 20 | −80 |
| | 300 | 120 | 20 | −100 |

Next, the embodiment will be described. For example, actual value data shown in Table 7 below is obtained from the history database 25. In Table 7 below, a vertical line is a basis weight, and a horizontal line is the correction amount ΔA of a preheater winding angle. Numbers in cells indicate sheet warped amounts for corresponding basis weights and the correction amounts ΔA of preheater winding angles, and blanks in cells indicate that there is no actual value data.

In the pre-control table, as in the case of the comparative example, with respect to basis weights 100, 150, 200, 250, and 300 [g/m$^2$], preheater winding angles 20, 20, 40, 100, and 120 [degree] are respectively set as the standard control values A.

TABLE 7

| | | Correction amount ΔA of preheater winding angle [degree] | | | | | |
|---|---|---|---|---|---|---|---|
| Sheet warped amount | | −40 | −20 | 0 | 20 | 40 | 80 |
| Basis weight [g/m$^2$] | 100 | | | 0.15 | 0.05 | | |
| | 150 | | | 0.10 | 0.07 | | |
| | 200 | | | 0.10 | 0.05 | | |
| | 250 | | 0.25 | 0.20 | | | |
| | 300 | | | | | | |

The warping prediction model M1 is prepared from actual value data of a preheater winding angle of Table 7 through linear regression, and a sheet warped amount in which a basis weight and a preheater winding angle are without actual value data is predicted from the warping prediction model M1 and is shown in Table 8. Specific cells of Table 8 are cells in which sheet warped amounts are predicted from the warping prediction model M1. The specific cells are basis weights 100, 150, 200, 250 300 intersecting preheater winding angle −40, basis weights 100, 150, 200, 300 intersecting preheater winding angle −20, basis weights 300 intersecting preheater weight angle 0, basis weights 250, 300 intersecting preheater angle 20, basis weights 100, 150, 200, 250, 300 intersecting preheater weight angle 40, basis weights 100, 150, 200, 250, 300 intersecting preheater angle 80. In addition, from the prediction result, the correction amount ΔA of the correction amount table 23 is updated based on a correction amount corresponding to the optimal preheater winding angle Aprd having the smallest sheet warped amount for each basis weight in the specific cells. The specific cells are basis weights 100, 150, 200, 250, 300 intersecting preheater winding angle 40. That is, the correction amount table 23 is updated such that 40 [degree] is set as the correction amount ΔA with respect to each of basis weights of 100, 150, 200, 250, and 300 [g/m$^2$].

TABLE 8

| | | Correction amount of preheater winding angle [degree] | | | | | |
|---|---|---|---|---|---|---|---|
| Sheet warped amount | | −40 | −20 | 0 | 20 | 40 | 80 |
| Basis weight [g/m$^2$] | 100 | 0.29 | 0.21 | 0.15 | 0.05 | −0.04 | −0.12 |
| | 150 | 0.30 | 0.22 | 0.10 | 0.07 | −0.03 | −0.11 |
| | 200 | 0.31 | 0.23 | 0.10 | 0.05 | −0.02 | −0.10 |
| | 250 | 0.32 | 0.25 | 0.20 | 0.08 | 0.00 | −0.09 |
| | 300 | 0.34 | 0.25 | 0.17 | 0.09 | 0.01 | −0.07 |

The initial control values Aset before correction (=A) and after correction (=A+ΔA) are organized in Table 9 below.

TABLE 9

| Initial control value Aset | | Before correction (=standard control value A) | After correction (=A + ΔA) | Correction amount |
|---|---|---|---|---|
| Basis weight [g/m$^2$] | 100 | 20 | 60 | 40 |
| | 150 | 20 | 60 | 40 |
| | 200 | 40 | 80 | 40 |
| | 250 | 100 | 140 | 40 |
| | 300 | 120 | 160 | 40 |

As described above, in the embodiment, after update, a correction amount ΔA from the standard control value A of preheater winding angle for basis weights of 250 and 300 [g/m$^2$] is 40 [degree], which is smaller compared to the comparative example. In addition, also the initial control value Aset of a preheater winding angle (=standard control value A+correction amount ΔA) still tends to increase as a basis weight increases.

That is because the standard control value A can be left as a base part of a control value since a correction amount of the correction amount table 23 is updated in the embodiment instead of updating the standard control value A of the pre-control table 21 itself. That is, this is because information that an increase in a sheet warped amount can be suppressed by setting a preheater winding angle to be larger as a basis weight increases, which is reflected in the pre-control table 21, can be reliably left.

[4. Third Embodiment]

[4-1. Configuration of Production Management Device]

Figure 10:
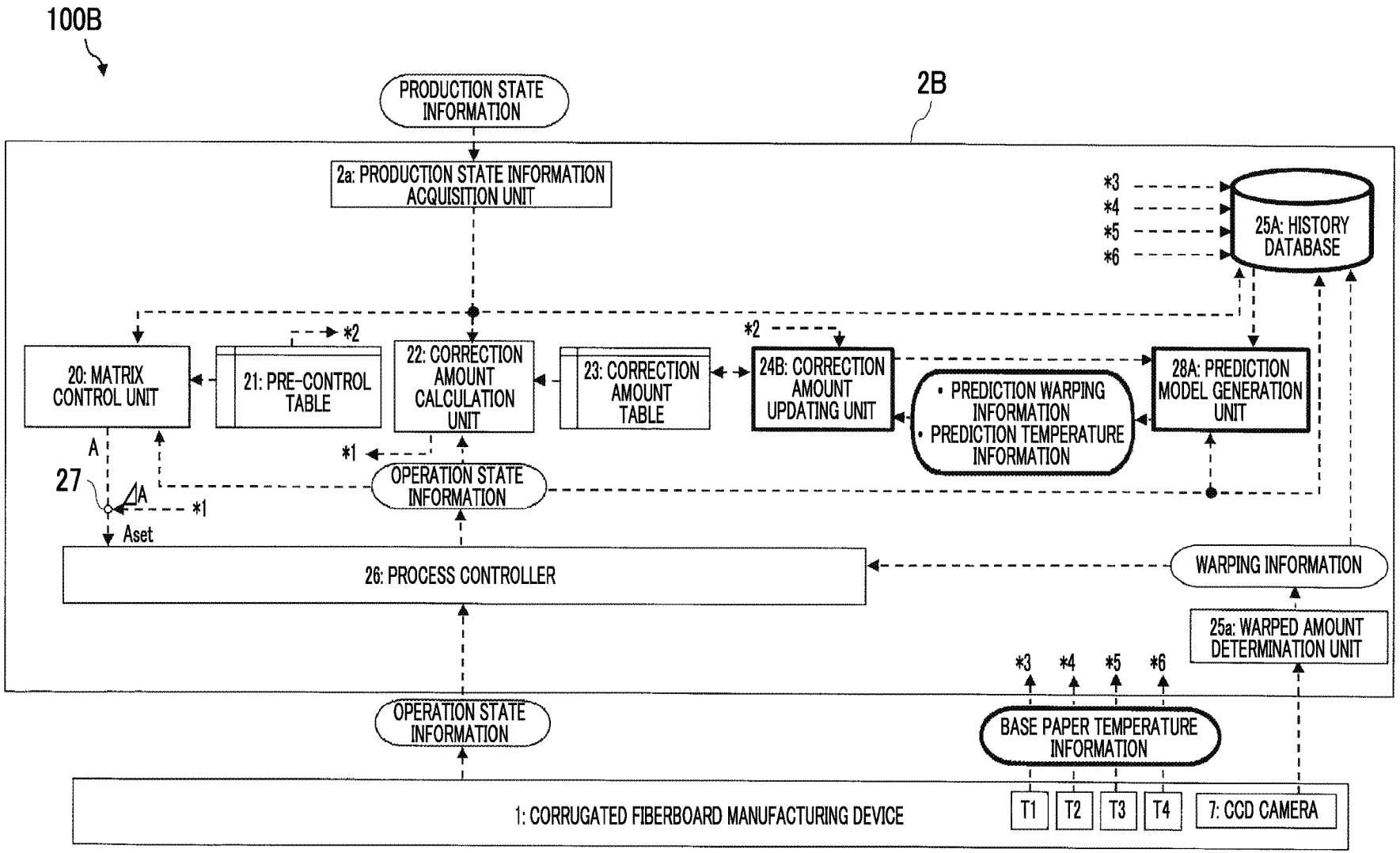
FIG. 10 is a schematic diagram showing a configuration of a corrugated fiberboard sheet manufacturing system according to a third embodiment of the present invention.
Figure 11:
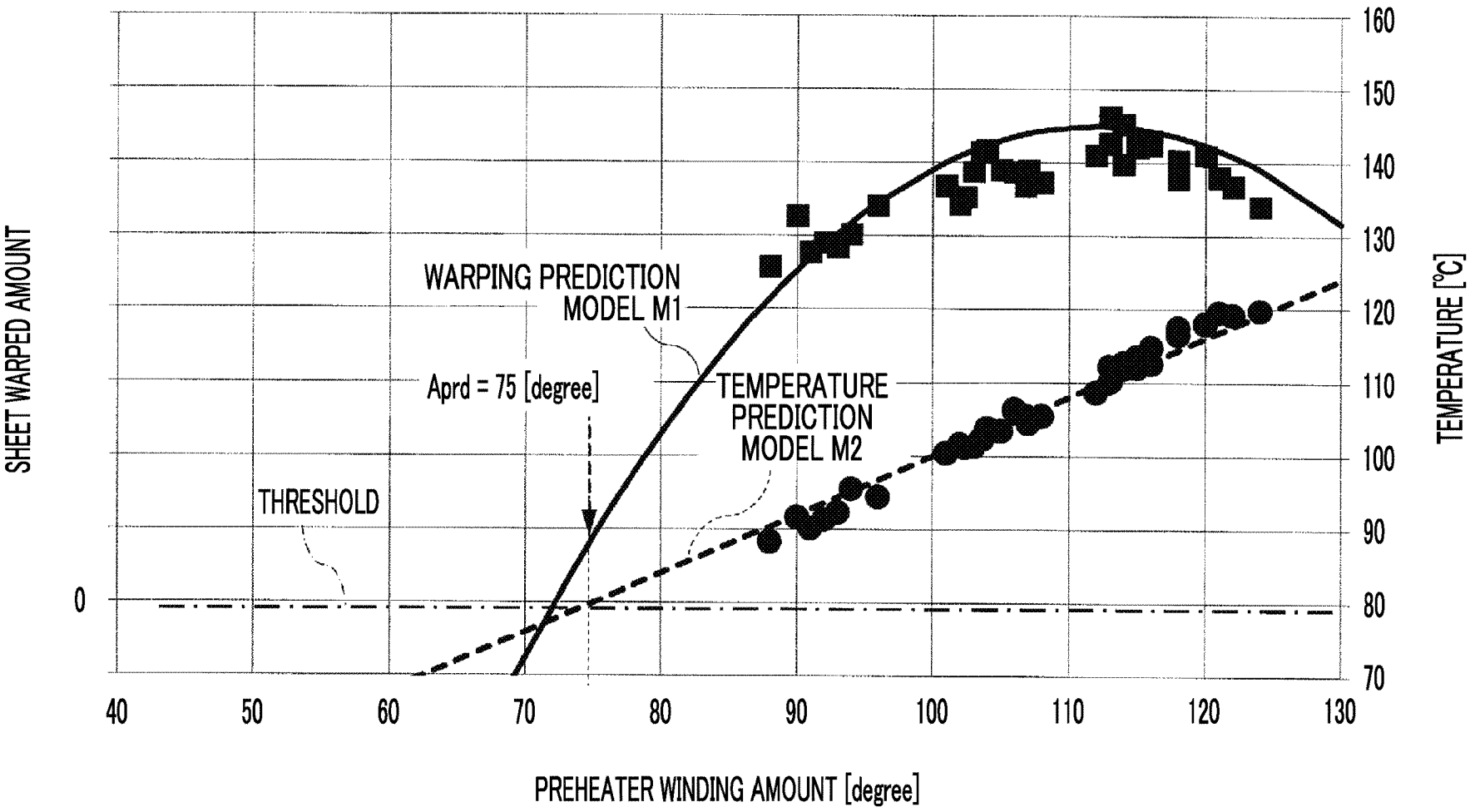
FIG. 11 is a schematic diagram for describing a warping prediction model and a temperature prediction model according to the third embodiment of the present invention.

A third embodiment of the present invention will be described with reference to FIGS. 10 and 11. A corrugated fiberboard sheet manufacturing system 100B of the embodiment is configured with the corrugated fiberboard manufacturing device 1 and a production management device 2B.

Since the production management device 2B of the embodiment is different from the production management device 2A of the second embodiment only in terms of functions of the history database, the prediction model generation unit, and the correction amount updating unit, only a history database 25A, a prediction model generation unit 28A, and a correction amount updating unit 24B, which are indicated with bold frames in FIG. 10, will be described. Since other configuration elements are the same as the second embodiment, the same reference signs as the second embodiment will be assigned in FIGS. 10 and 11, and description thereof will be omitted.

The history database 25A acquires temperature information of the base paper 30 to 33 at a preheater outlet or on a slightly downstream side of the preheater outlet from the temperature sensors T1, T2, T3, and T4, and includes at least one of temperature information pieces of the base paper 30 to 33 as information configuring an actual data set.

In addition to warped amount information, the prediction model generation unit 28A acquires temperature information as an actual data set from the history database 25A. In addition to the warping prediction model M1, a temperature prediction model M2 through which a temperature from a preheater winding angle is predicted is generated based on temperature information indicated with filled circles as shown in FIG. 11. In this manner, the prediction model generation unit 28A is configured by integrating the first prediction model generation means and second prediction model generation means of the present invention. It is evident that the first prediction model generation means and the second prediction model generation means may be separately configured.

Out of preheater winding angles at which temperatures estimated through the temperature prediction model M2 are higher than the threshold temperature, the correction amount updating unit 24B sets a preheater winding angle at which a sheet warped amount is smallest as the optimal preheater winding angle Aprd. As shown in an example shown in FIG. 11, 75 [degree] is set as the optimal preheater winding angle Aprd. The threshold temperature is a temperature having a possibility that defective attachment occurs when becoming equal to or lower than that, or a temperature obtained by adding a margin to this temperature.

[4-2. Operation and Effect]

In the embodiment, the occurrence of defective attachment can be suppressed since the correction amount table 23 is updated such that a temperature becomes a temperature without a possibility that defective attachment occurs, in addition to having operation and effects of the second embodiment.

[5. Fourth Embodiment]

[5-1. Configuration of Production Management Device]

A fourth embodiment of the present invention will be described with reference to FIGS. 12 and 13. A corrugated fiberboard sheet manufacturing system 100C of the embodiment is configured with the corrugated fiberboard manufacturing device 1 and a production management device 2C.

Figure 12:
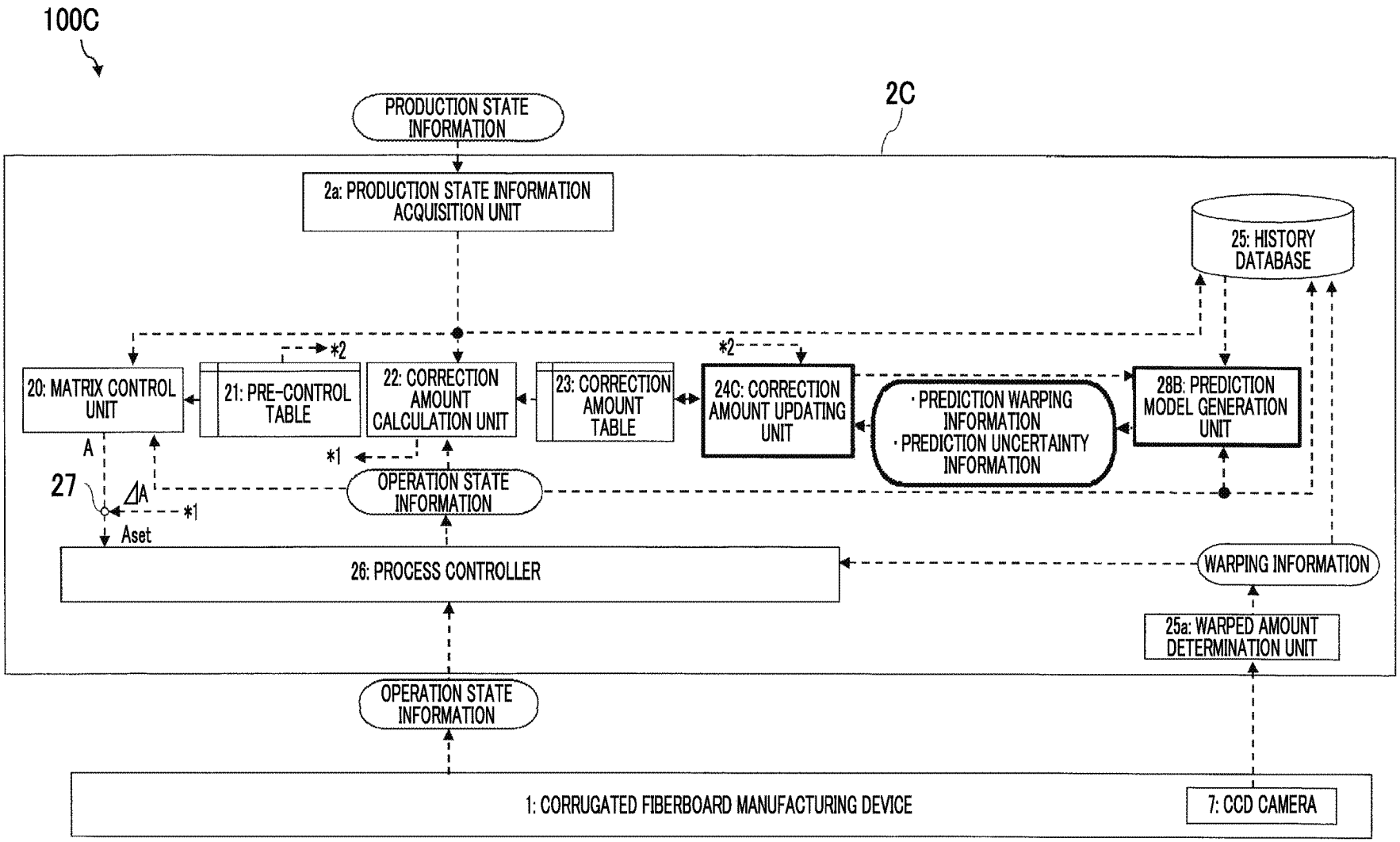
FIG. 12 is a schematic diagram showing a configuration of a corrugated fiberboard sheet manufacturing system according to a fourth embodiment of the present invention.
Figure 13:
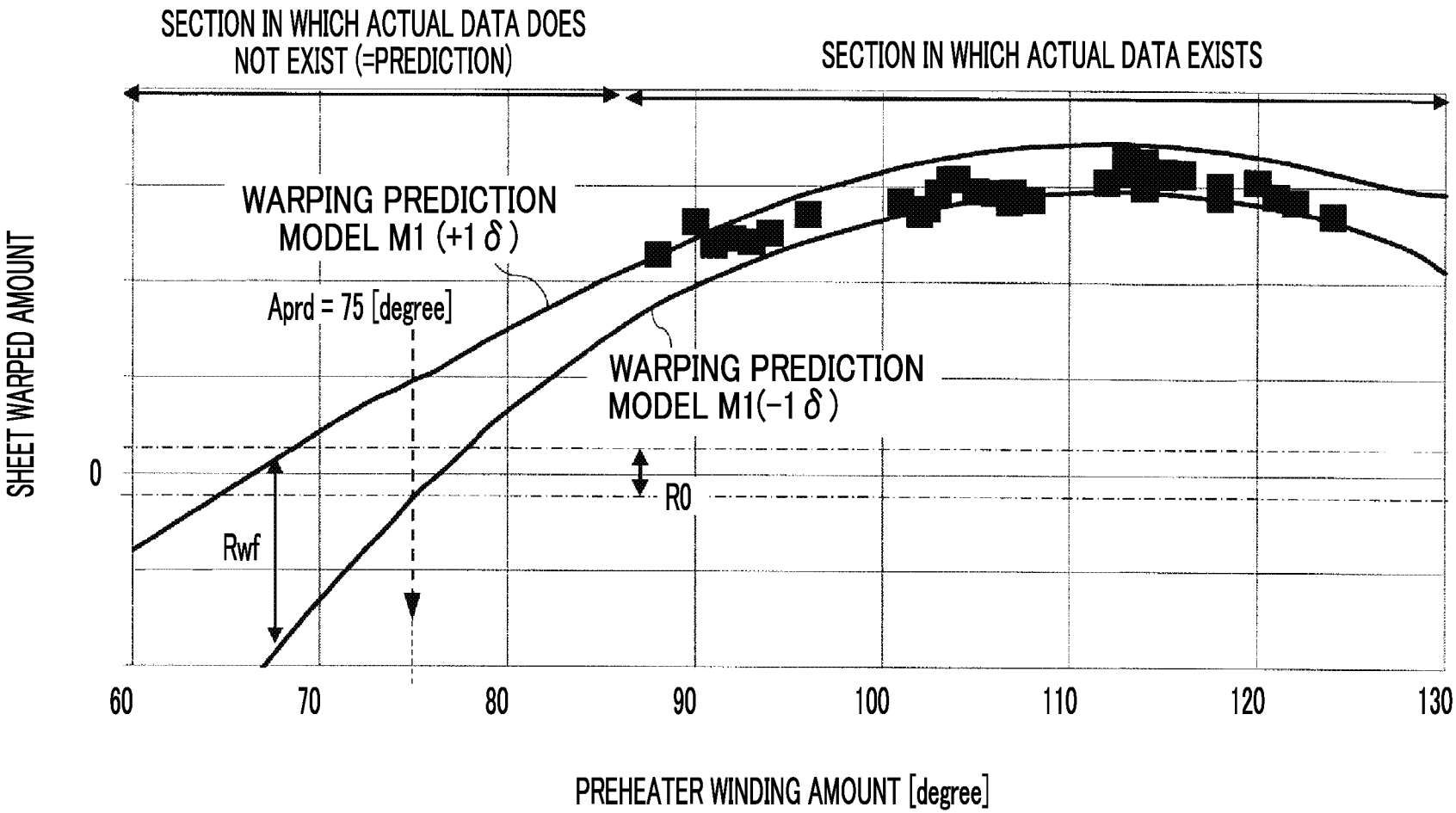
FIG. 13 is a schematic diagram for describing a warping prediction model according to the fourth embodiment of the present invention.

As shown in FIG. 12, portions indicated with bold frames of the corrugated fiberboard sheet manufacturing system 100C and the production management device 2C of the embodiment are different from the second embodiment. That is, the embodiment is partially different from the second embodiment in terms of functions of a prediction model generation unit 28B and a correction amount updating unit 24C. Since other configuration elements are the same as the second embodiment, the same reference signs as the second embodiment will be assigned, and description thereof will be omitted.

The correction amount updating unit 24C outputs a cell to become an update target to the prediction model generation unit 28B.

The prediction model generation unit 28B creates a warping prediction model M1 (+1δ) and a warping prediction model M1 (−1δ) for the update target cell, which is requested from the correction amount updating unit 24C, based on the actual data set acquired from the history database 25, and stores the warping prediction models.

The correction amount updating unit 24C acquires the optimal preheater winding angle Aprd for a cell to become an update target by using the warping prediction model M1 (+1δ) and the warping prediction model M1 (−1δ) that are generated by the prediction model generation unit 28B, and updates the correction amount table 23 by using a value of the correction amount ΔA of the update target cell based on a difference between the standard control value A acquired from the pre-control table 21 and the optimal preheater winding angle Aprd (=Aprd−A).

The correction amount updating unit 24C and the prediction model generation unit 28B will be further described with reference to FIG. 13 with a preheater winding angle [degree] given as an example of a control element.

The prediction model generation unit 28B acquires an actual data set, which is in the range of the update target cell, from the history database 25. The warping prediction models M1 (+1δ) and M1 (−1δ) are generated from actual data sets indicated with filled squares in FIG. 13 through the same method as the second embodiment. In the warping prediction models M1 (+1δ) and M1 (−1δ), the uncertainty of standard deviation Δ is expected on each of a plus side and a minus side with respect to the warping prediction model M1 of the second embodiment. A calculating method of such uncertainty is not limited to a certain method.

The correction amount updating unit 24C predicts a sheet warped amount as a region sandwiched between the two warping prediction models M1 (+1δ) and M1 (−1δ). That is, the correction amount updating unit 24C predicts a sheet warped amount with respect to a preheater winding angle as a prediction width Rwf which is a width attributable to prediction uncertainty. The prediction width Rwf becomes wider in a region where an actual data set is smaller, and becomes wider as separated further away from a region where an actual data set exists.

The correction amount updating unit 24C sets a preheater winding angle at which a proportion of the prediction width Rwf overlapping an allowable range R0 of a sheet warped amount is highest as the optimal preheater winding angle Aprd. In an example shown in FIG. 13, 75 [degree] is set as the optimal preheater winding angle Aprd.

[5-2. Operation and Effect]

In the embodiment, a sheet warped amount is predicted as the prediction width Rwf, and a preheater winding angle at which a proportion of the prediction width Rwf overlapping the allowable range R0 of a sheet warped amount is highest is set as the optimal preheater winding angle Aprd. Since the prediction width Rwf increases as prediction uncertainty increases, a preheater winding angle at which prediction uncertainty increases as an operation actual value becomes smaller is unlikely to be set as the optimal preheater winding angle Aprd.

Therefore, it can be suppressed that an inappropriate preheater winding angle is selected as the optimal preheater winding angle Aprd, and thereby the correction amount table 23 can be appropriately updated. Therefore, the warping of the corrugated fiberboard 35 can be more quickly rectified.

[5-3. Modification Example]

Figure 14:
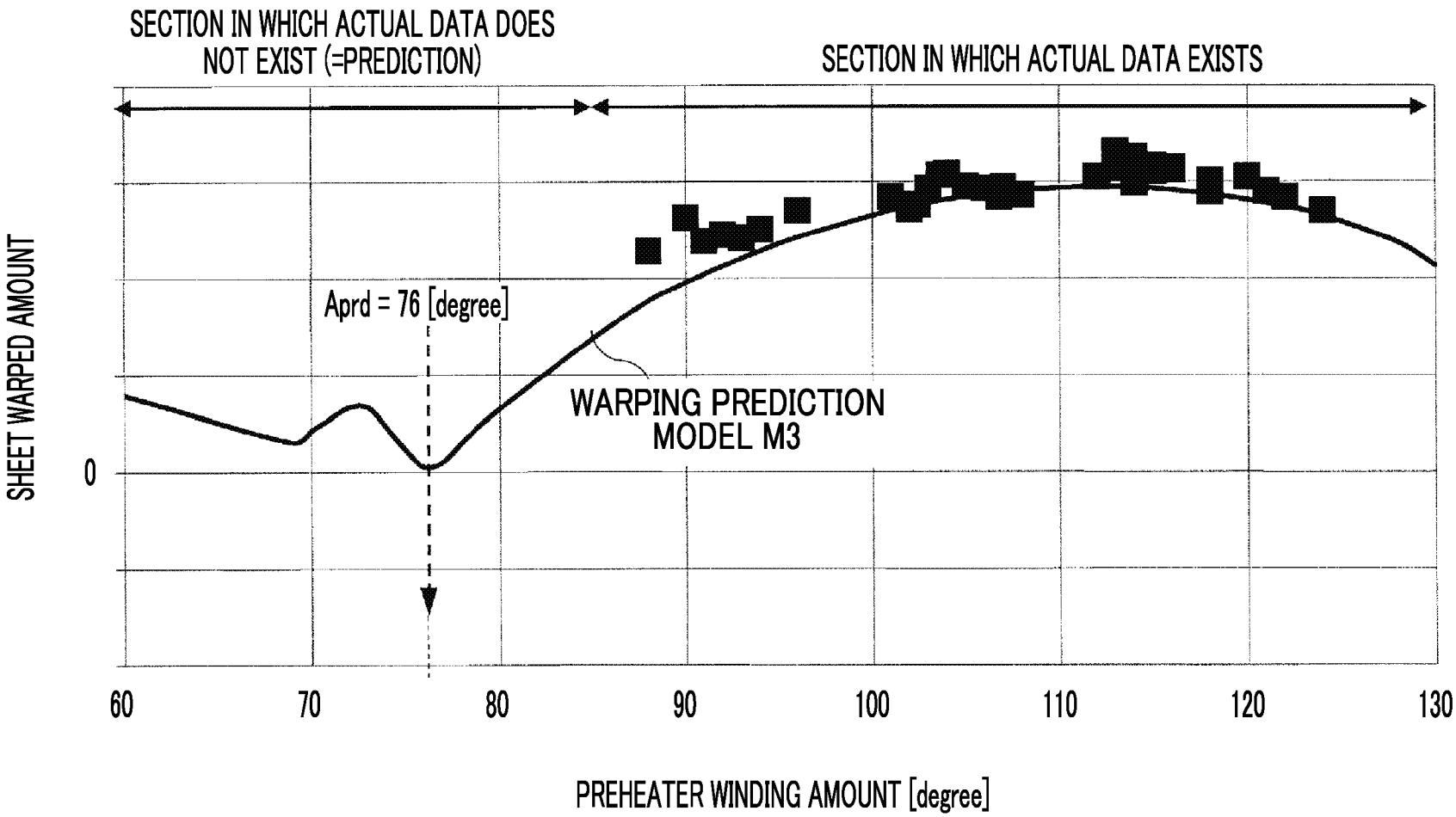
FIG. 14 is a schematic diagram for describing a warping prediction model according to a modification example of the fourth embodiment of the present invention.

As shown in FIG. 14, the prediction model generation unit 28B generates a severest warping prediction model M3 in which a predicted sheet warped amount is maximum, for example, through a Gaussian process and Bayesian regression, and a preheater winding angle at which the prediction model M3 is smallest may be used as the optimal preheater winding angle Aprd in updating the correction amount table 23. In an example shown in FIG. 14, 76 [degree] is set as the optimal preheater winding angle Aprd.

[6. Fifth Embodiment]

[6-1. Configuration of Production Management Device]

Figure 15:
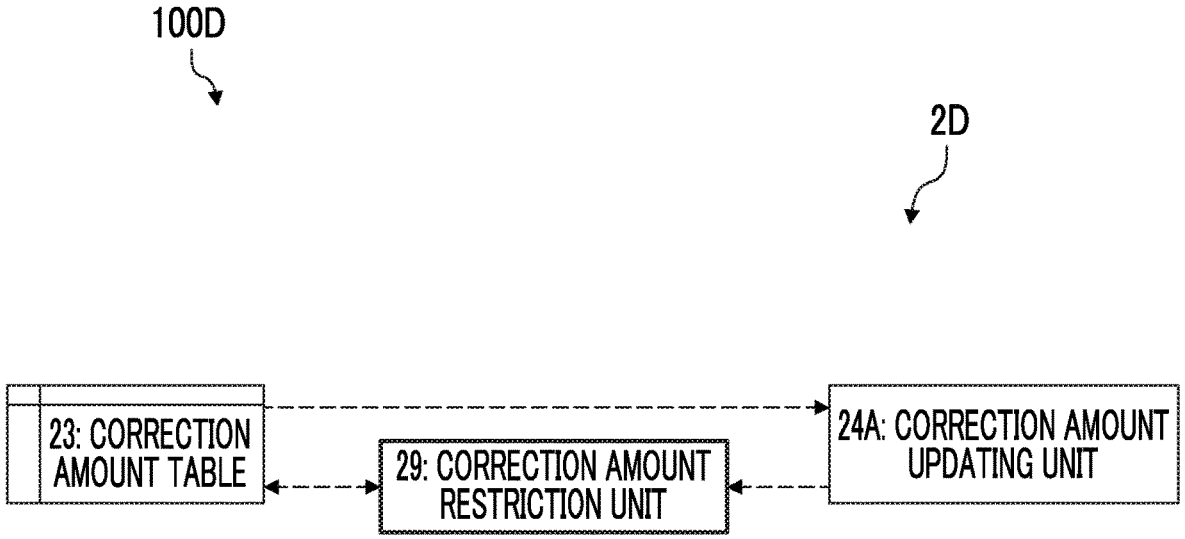
FIG. 15 is a schematic diagram showing a configuration of important parts of a corrugated fiberboard sheet manufacturing system according to a fifth embodiment of the present invention.

A production management device 2D according to a fifth embodiment of the present invention will be described with reference to FIG. 15 which shows important parts.

Since a corrugated fiberboard sheet manufacturing system 100D and the production management device 2D of the embodiment is the same as the second embodiment shown in FIG. 8 except that a correction amount restriction unit 29 shown with a bold frame is included, only the correction amount restriction unit 29 will be described.

When the correction amount updating unit 24A updates the correction amount ΔA of a correction target cell, the correction amount restriction unit 29 restricts a breadth of change, which is attributable to the update, to be under a threshold value. Specifically, for the correction target cell, the correction amount restriction unit 29 acquires the current correction amount ΔA from the correction amount table 23, and acquires a correction amount ΔA', which is planned to be used after update, from the correction amount updating unit 24A. In a case where an absolute value of a difference between the current correction amount and the correction amount planned to be used after update (=ΔA'−ΔA), that is, the breadth of change of the correction amount exceeds the threshold value, the breadth of change corrects the correction amount ΔA' to fall below the threshold value. As a specific example, in a case where the current correction amount ΔA of the update target cell is 40 [degree], the correction amount ΔA' planned to be used after update is 100 [degree], and the threshold value is 10 [degree], the correction amount restriction unit 29 corrects the correction amount ΔA' to be 50 [degree].

[6-2. Operation and Effect]

(1) In the embodiment, a breadth of change of the correction amount ΔA accompanying update is restricted, and a breadth of change of the initial control value Aset is restricted. In a case where the uncertainty of the warping prediction model M1 is high, also the correction amount ΔA' calculated based on the warping prediction model M1 is estimated to have high uncertainty. Therefore, when updating the correction amount table 23 based on the correction amount ΔA', there is a risk that the initial control value Aset becomes an inappropriate value and the warping of the corrugated fiberboard 35 is cannot be suppressed. However, even in a case where the uncertainty of the warping prediction model M1 is high, such a risk can be avoided by restricting a breadth of change of the correction amount ΔA.

(2) In the embodiment, a complicated process for generating the warping prediction models M1 (+1δ) and M1 (−1δ) can be omitted since the uncertainty of a prediction model can be dealt with by restricting a change amount of the correction amount ΔA, compared to the fourth embodiment which deals with the uncertainty of the prediction models by generating the warping prediction models M1 (+1δ) and M1 (−1δ).

[7. Others]

(1) Although the second to fifth embodiments have a configuration where the prediction model generation units 28, 28A, and 28B are added to the configuration of the first embodiment, a prediction model generation unit may be added to the first modification example to the third modification example of the first embodiment.

(2) Although the fifth embodiment has a configuration where the correction amount restriction unit 29 is added to the configuration of the second embodiment, the correction amount restriction unit may be added to the other embodiments and the other modification examples.

REFERENCE SIGNS LIST

1: corrugated fiberboard manufacturing device

2, 2-1, 2-2, 2-3, 2A, 2B, 2C, 2D: production management device

2*a*: production state information acquisition unit (production state information acquisition means)

7: CCD camera

10: top liner preheater

12: medium preheater

13: single-faced web preheater

14: bottom liner preheater

20: matrix control unit

21: pre-control table

21*a*: control table (correction table)

23: correction amount table (correction table)

23*a*: control table after correction (correction table)

23*b*: control table after correction (correction table)

24, 24A, 24B, 24C: correction amount updating unit (updating means)

24*a*: control value updating unit (updating means)

25, 25A: history database (storage means)

25*a*: warped amount determination unit

26: process controller (control means, control value information acquisition means)

27: addition unit (addition means)

28, 28B: prediction model generation unit (first prediction model generation means)

28A: prediction model generation unit (first prediction model generation means, second prediction model generation means)

29: correction amount restriction unit (restriction means)

30: top liner (base paper)

31: medium (base paper)

32: single-faced web (base paper)

33: bottom liner (base paper)

35: corrugated fiberboard

100, 100-1, 100-2, 100-3, 100A, 100B, 100C, 100D: corrugated fiberboard sheet manufacturing system T1, T2, T3, T4: temperature sensor (temperature acquisition means)

The invention claimed is:

1. A corrugated fiberboard sheet manufacturing system comprising:

production state information acquisition means for acquiring production state information related to a production state of a corrugated fiberboard manufacturing device;

a process controller including control value information acquisition means for acquiring control value information of a control element of the corrugated fiberboard manufacturing device which affects a warped amount of a manufactured corrugated fiberboard, and control means for feedforward-controlling the control element by using the initial control value;

warping information acquisition means for acquiring warping information related to the warped amount of the corrugated fiberboard;

storage means for storing a plurality of actual data sets including at least the production state information, the control value information, and the warping information;

a pre-control table in which a standard control value of the control element is set according to the production state;

a correction table for setting an initial control value by correcting the standard control value; and updating means for updating the correction table by extracting, when a certain amount of actual data sets is accumulated in the storage means, an actual data set including the warping information related to a minimum warping amount from the plurality of actual data sets stored in the storage means and reflecting the extracted actual data set in the correction table.

2. The corrugated fiberboard sheet manufacturing system according to claim 1, further comprising:

a correction amount table, in which a correction amount for correcting the standard control value of the pre-control table is set according to the production state, as the correction table; and addition means for calculating the initial control value by adding the correction amount to the standard control value.

* * * * *